US010215080B2

(12) United States Patent
Styron

(10) Patent No.: US 10,215,080 B2
(45) Date of Patent: Feb. 26, 2019

(54) SYSTEMS AND METHODS FOR RAPID ENGINE COOLANT WARMUP

(71) Applicant: Ford Global Technologies, LLC, Dearborn, MI (US)

(72) Inventor: Joshua Putman Styron, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 137 days.

(21) Appl. No.: 15/340,164

(22) Filed: Nov. 1, 2016

(65) Prior Publication Data

US 2018/0119597 A1 May 3, 2018

(51) Int. Cl.

| | |
|---|---|
| ***F01P 7/16*** | (2006.01) |
| ***F01P 7/14*** | (2006.01) |
| ***F01P 3/20*** | (2006.01) |
| ***F01P 5/10*** | (2006.01) |

(52) U.S. Cl.

CPC ..... *F01P 7/165* (2013.01); *F01P 3/20* (2013.01); *F01P 5/10* (2013.01); *F01P 2007/146* (2013.01); *F01P 2023/08* (2013.01); *F01P 2025/40* (2013.01); *F01P 2025/50* (2013.01); *F01P 2037/02* (2013.01); *F01P 2060/08* (2013.01); *F01P 2060/12* (2013.01); *F01P 2060/18* (2013.01)

(58) Field of Classification Search

CPC .. F01P 7/165; F01P 7/048; F01P 7/044; F01P 7/164; F01P 7/16; F01P 5/10; F01P 11/18; F01P 11/02; F01P 11/04; F01P 3/20; F01P 2007/146; F01P 2037/02; F02D 35/0007

See application file for complete search history.

(56) References Cited

U.S. PATENT DOCUMENTS

| | | | | |
|---|---|---|---|---|
| 4,513,695 | A * | 4/1985 | Patchen, II | F01P 3/20 123/41.1 |
| 4,621,594 | A * | 11/1986 | Kubis | F01P 3/207 123/41.09 |
| 5,638,774 | A | 6/1997 | Albertson et al. | |
| 5,724,924 | A | 3/1998 | Michels | |
| 6,364,213 | B1 * | 4/2002 | Baltz | F01P 7/16 123/41.01 |
| 7,207,298 | B2 | 4/2007 | Lee | |
| 8,689,617 | B2 | 4/2014 | Rollinger | |

(Continued)

*Primary Examiner* — Lindsay Low
*Assistant Examiner* — George Jin
(74) *Attorney, Agent, or Firm* — Julia Voutyras; McCoy Russell LLP

(57) ABSTRACT

Methods and systems are provided for regulating coolant flow in a vehicle cooling system during an engine startup event. In one example, a method may include, during an engine startup event, controlling a flowpath of an engine coolant in a vehicle cooling system via a passive valve and an actively regulatable valve, and responsive to an engine coolant temperature below a threshold at the engine startup event, isolating the flowpath of engine coolant to a subsection of the cooling system to enable rapid warming of the engine coolant without stagnating the engine coolant at an engine. In this way, engine coolant may be rapidly warmed at an engine startup event, via coolant flow isolation, rather than coolant flow stagnation, which may decrease uneven heating of engine system components, and which may thus prolong a functional lifetime of the engine system.

18 Claims, 6 Drawing Sheets

(56) References Cited

U.S. PATENT DOCUMENTS

| | | | | |
|---|---|---|---|---|
| 9,022,647 | B2 | 5/2015 | Jentz et al. | |
| 9,458,759 | B2 | 10/2016 | Rollinger et al. | |
| 2008/0168956 | A1* | 7/2008 | Lutz | F01P 3/02 123/41.1 |
| 2010/0186684 | A1* | 7/2010 | Utsuno | F01N 5/02 123/41.1 |
| 2013/0255604 | A1 | 10/2013 | Rollinger et al. | |
| 2015/0027386 | A1* | 1/2015 | Lewis | F01P 7/16 123/41.1 |
| 2015/0059665 | A1* | 3/2015 | Quix | F01P 3/12 123/41.09 |
| 2016/0084142 | A1 | 3/2016 | Gooden et al. | |
| 2016/0186645 | A1 | 6/2016 | Rollinger et al. | |
| 2016/0186647 | A1 | 6/2016 | Styron et al. | |
| 2016/0186648 | A1 | 6/2016 | Rollinger et al. | |
| 2016/0186649 | A1 | 6/2016 | Rollinger et al. | |

* cited by examiner

SYSTEMS AND METHODS FOR RAPID ENGINE COOLANT WARMUP

FIELD

The present description relates generally to methods and systems for controlling a vehicle engine to regulate a volume of coolant circulating based on coolant temperature.

BACKGROUND/SUMMARY

Vehicles may include cooling systems configured to reduce overheating of an engine by transferring the heat to ambient air. Therein, coolant is circulated through the engine block to remove heat from the hot engine, and the heated coolant is then circulated through a radiator near the front of the vehicle. Heated coolant may also be circulated through a heat exchanger to heat a passenger compartment. The cooling system may include various components such as various valves and one or more thermostats.

While vehicles may include cooling systems to reduce overheating of the engine, it may additionally be understood that vehicle systems tend to operate most efficiently when in an optimal temperature range. For example, operating the engine well above the optimal temperature may present durability complications, while operating the engine well below the optimal temperature may result in degraded efficiency. Thus, opportunities exist to increase efficiency by helping engine systems reach and maintain their optimum operating temperature rapidly during a cold start.

Toward this end, US Patent Application US 2013/0255604 teaches a cooling system configured to circulate coolant to various vehicle system components via a plurality of valves. Such valves may include a bypass shut-off valve, a heater shut-off valve, a thermostat valve, a transmission cooling valve, a transmission heating valve, etc. During an engine cold start, the heater shut-off valve and the bypass shut-off valve may be closed for a first duration to stagnate coolant at the engine and expedite engine warm-up. Then, after the engine has been sufficiently warmed, one or more of the bypass shut-off valve and the heater shut-off valve may be actuated open to allow the previously stagnating, and now heated, coolant to reach the thermostat. Responsive to the heated coolant reaching the thermostat, the thermostat valve may be opened, resulting in coolant flow through a radiator.

However, the inventors herein have recognized potential issues with such an approach. First, stagnating coolant flow in the engine to allow for rapid warm-up may result in durability issues, due to uneven heating of various engine components. Furthermore, the use of electronic valves to selectively control coolant circulation in various coolant loops is costly, and adds complexity to the vehicle system. For example, the addition of costly electronic valves necessitates the continual diagnosis of the valves, to ensure the valves, and thereby the vehicle cooling system, is functioning as desired.

The inventors herein have recognized these issues, and have developed systems and methods to at least partially address the above issues. In one example, a method is provided, comprising during an engine startup event, controlling a flowpath of an engine coolant in a vehicle cooling system via a passive valve and an actively regulatable valve; and responsive to an engine coolant temperature below a threshold at the engine startup event, isolating the flowpath of engine coolant to a subsection of the cooling system to enable rapid warming of the engine coolant without stagnating the engine coolant at an engine.

In one example, controlling the flowpath of the engine coolant in the vehicle cooling system via the passive valve comprises controlling the flowpath of the engine coolant in the vehicle cooling system via a first thermostat valve of a first thermostat positioned on a hot-side of the engine, including controlling the first thermostat valve to a first, a second, or a third position based on engine coolant temperature as sensed by a first temperature sensing element of the first thermostat, without input from a vehicle controller. In such an example, controlling the flowpath of the engine coolant in the vehicle cooling system via the actively regulatable valve comprises controlling the flowpath of the engine coolant in the vehicle cooling system via a second thermostat valve of a second thermostat positioned on a cold-side of the engine, including one or more of controlling the second thermostat valve to a fourth, a fifth, or a sixth position based on engine coolant temperature as sensed by a second temperature sensing element of the second thermostat without input from the vehicle controller; and controlling the second thermostat valve to the fifth or sixth position actively by activating an electric heater associated with the second thermostat thereby raising a temperature of the second thermostat.

In another example, controlling the flowpath of the engine coolant in the vehicle cooling system via the passive valve comprises controlling the flowpath of the engine coolant in the vehicle cooling system via a third thermostat valve of a third thermostat positioned on a cold-side of the engine, including controlling the third thermostat valve to a seventh, an eighth, or a ninth positon based on engine coolant temperature as sensed by a third temperature sensing element of the third thermostat, without input from a vehicle controller. In such an example, controlling the flowpath of the engine coolant in the vehicle cooling system via the actively regulatable valve comprises controlling the flowpath of the engine coolant in the vehicle cooling system via an actuatable solenoid valve positioned on the cold-side of the engine, and where the actuatable solenoid valve is configurable in an open position, or a closed position.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
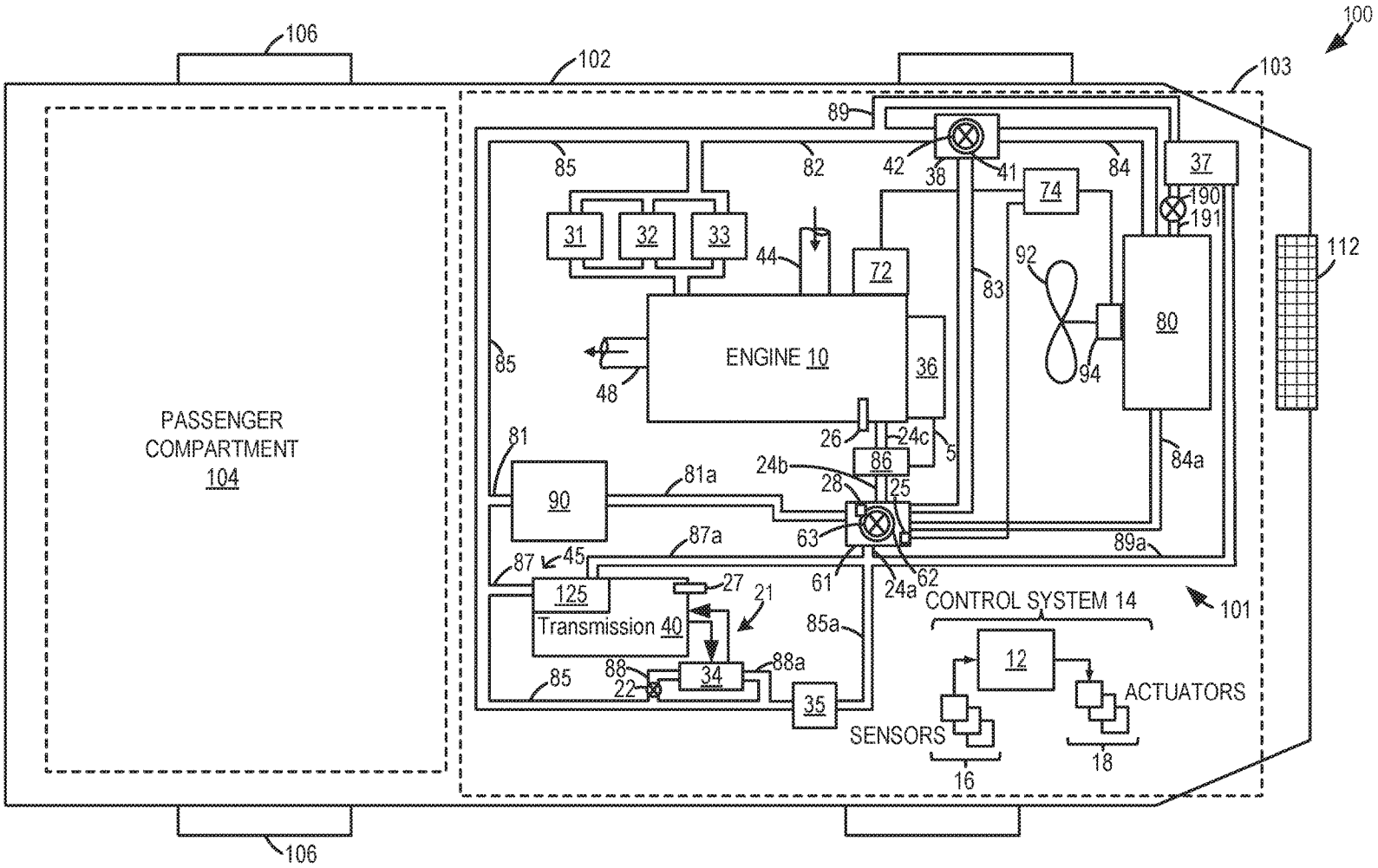
FIG. 1 schematically shows an example vehicle cooling system configured with two conventional thermostats for controlling coolant flow, wherein one of the thermostats comprises an electrically-heated thermostat.
Figure 2:
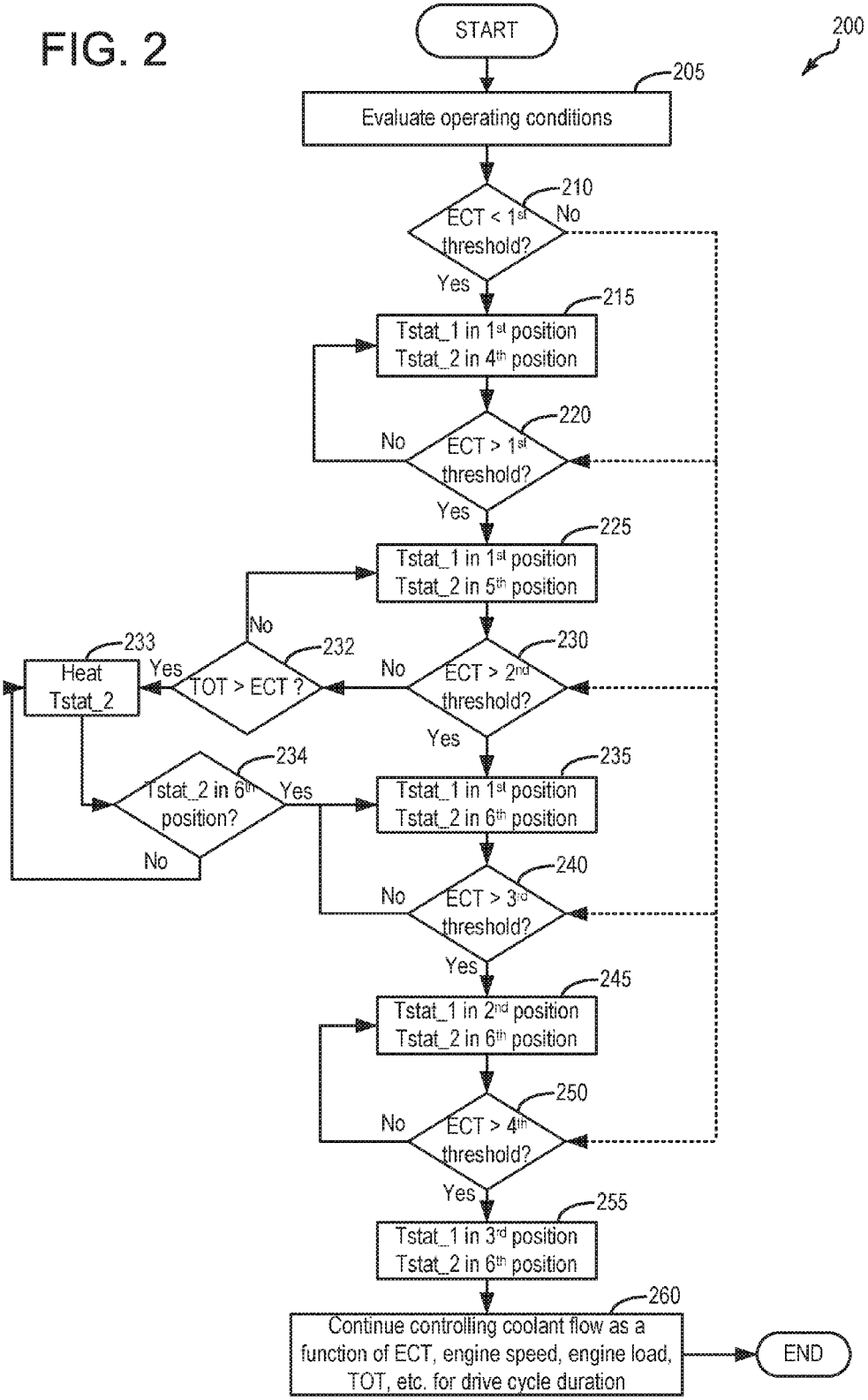
FIG. 2 shows a high-level flowchart for an example method for controlling coolant flow during an engine startup event, according the system of FIG. 1.

The following description relates to systems and methods for regulating coolant flow in a vehicle cooling system during an engine startup event. In one example, the vehicle cooling system may include two conventional thermostats, wherein a first thermostat may be positioned on a hot side of the vehicle cooling system, and wherein a second thermostat may be positioned on a cold side of the vehicle cooling system, as depicted in FIG. 1. In such an example, the second thermostat may comprise an electrically-heated thermostat. A method for controlling coolant flow during an engine startup event, according to the system depicted at FIG. 1, is illustrated in FIG. 2. Briefly, such a method may comprise isolating the coolant flow to a subsection of the cooling system including a bypass line in a first condition, prior to returning to an engine, via the first thermostat valve in a first position and the second thermostat valve in a fourth position, responsive to engine coolant temperature below a first threshold. Furthermore, responsive to a second condition including engine coolant temperature above the first threshold but below a second threshold, such a method may include flowing coolant from the engine through both the bypass line and a heater core, prior to returning to the engine, via the first thermostat valve in the first position and the second thermostat valve in a fifth position.

The method illustrated in FIG. 2 may further comprise routing coolant flow from the engine through each of the bypass line, the heater core, a transmission oil cooler, an automatic transmission warmup heat exchanger, and a degas bottle, prior to returning to the engine in a third condition. The third condition may include either engine coolant temperature above the second threshold, but below a third threshold, or responsive to a transmission oil temperature above engine coolant temperature by a predetermined amount and engine coolant temperature below the second threshold. In such an example method, routing coolant flow through each of the bypass line, the heater core, the transmission oil cooler, the automatic transmission warmup heat exchanger, and the degas bottle may include the first thermostat valve in the first position and the second thermostat valve in a sixth position. In another example, routing coolant flow through each of the bypass line, the heater core, the transmission oil cooler, the automatic transmission warmup heat exchanger, and the degas bottle may include responsive to the transmission oil temperature above engine coolant temperature by the predetermined amount and engine coolant temperature below the second threshold, activating the electric heater associated with the second thermostat to configure the second thermostat valve in the sixth position.

The method illustrated in FIG. 2 may further comprise routing coolant flow from the engine, through each of the bypass line, the heater core, the transmission oil cooler, the automatic transmission warmup heat exchanger, the degas bottle, and a radiator, prior to returning to the engine in a fourth condition, responsive to engine coolant temperature above the third threshold, but below a fourth threshold. In such an example, routing coolant flow from the engine, through each of the bypass line, the heater core, the transmission oil cooler, the automatic transmission warmup heat exchanger, the degas bottle, and the radiator may include the first thermostat valve in a second position and the second thermostat valve in the sixth position. In still another example, the method illustrated in FIG. 2 may further comprise routing coolant flow from the engine, through each of the heater core, the transmission oil cooler, the automatic transmission warmup heat exchanger, the degas bottle, and the radiator, prior to returning to the engine in a fifth condition, responsive to engine coolant temperature above the fourth threshold. In such an example, routing coolant flow from the engine, through each of the heater core, the transmission oil cooler, the automatic transmission warmup heat exchanger, the degas bottle, and the radiator may include the first thermostat valve in a third position and the second thermostat valve in the sixth position, and wherein coolant is prevented from flowing through the bypass line in the fifth condition.

Figure 3:
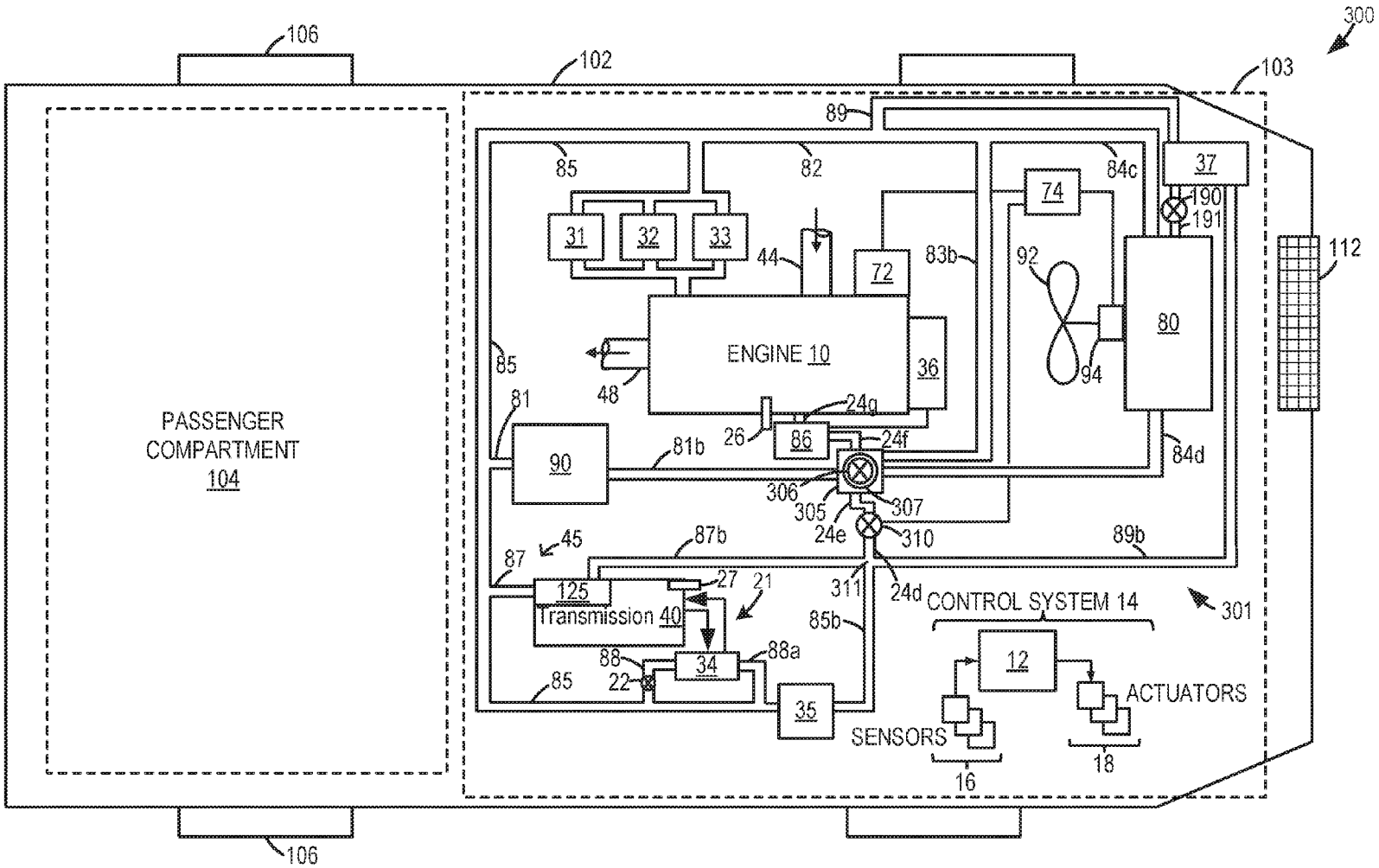
FIG. 3 schematically shows an example vehicle cooling system configured with one conventional thermostat, and one solenoid actuated valve, for controlling coolant flow.
Figure 4:
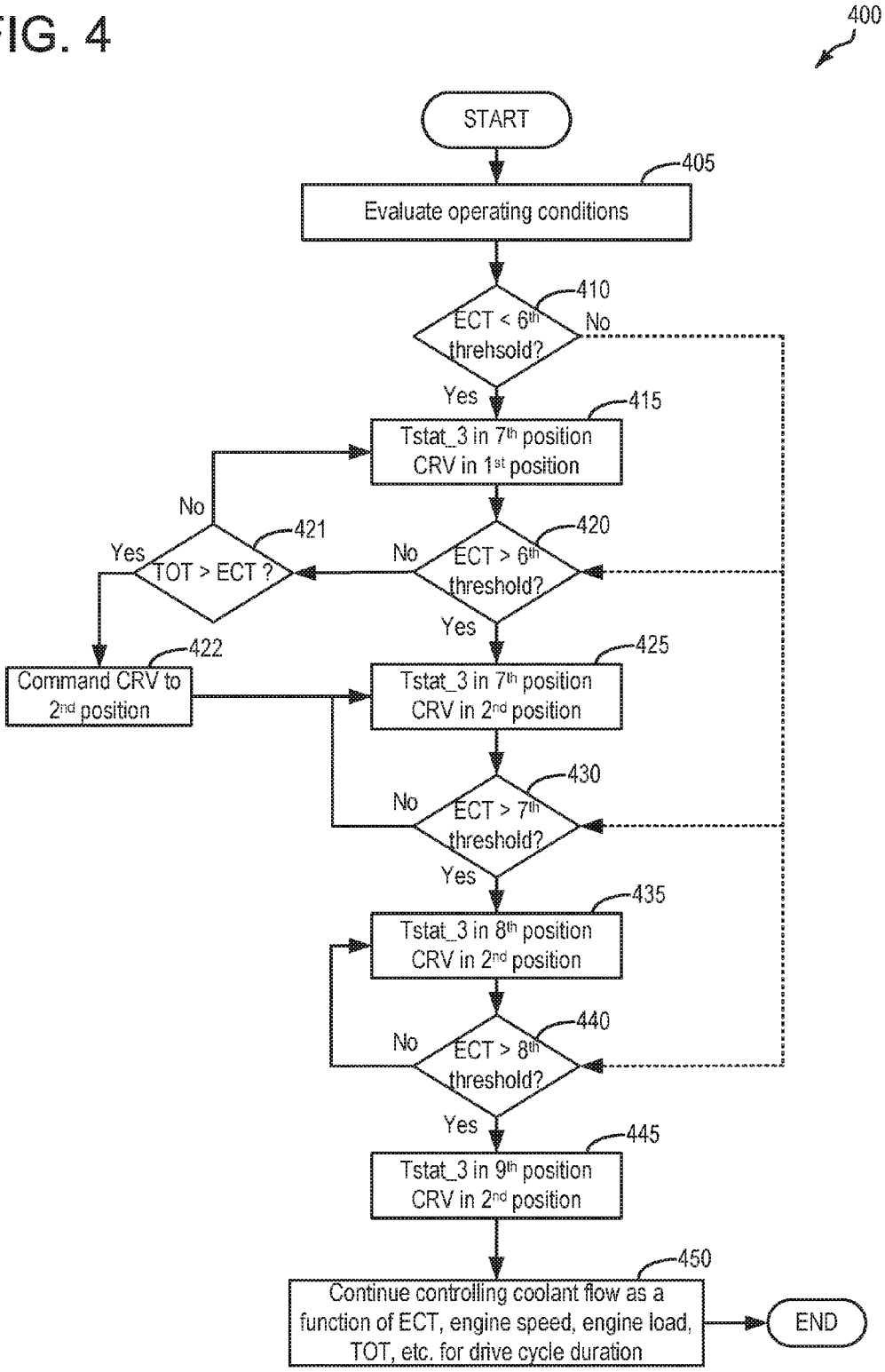
FIG. 4 shows a high-level flowchart for an example method for controlling coolant flow during an engine startup event, according to the system of FIG. 3.

In another example, the vehicle cooling system may include one conventional wax element thermostat (e.g. third thermostat) with a third thermostat valve, and one actuatable solenoid valve. In such an example, both the third thermostat valve, and the actuatable solenoid valve, may be positioned on a cold-side of the vehicle engine, as depicted in FIG. 3. A method for controlling coolant flow during an engine startup event, according to the system depicted at FIG. 3, is illustrated in FIG. 4. Such a method may comprise isolating the coolant flow to a subsection of the cooling system including a bypass line and a heater core in a sixth condition, prior to returning to the engine, via the third thermostat valve in a seventh position, and the actuatable solenoid valve in a closed position, responsive to engine coolant temperature below a sixth threshold.

The method illustrated in FIG. 4 may further comprise routing coolant flow from the engine, through each of the bypass line, the heater core, a transmission oil cooler, an automatic transmission warmup heat exchanger, an oil cooler, and a degas bottle in a seventh condition, prior to returning to the engine, responsive to either engine coolant temperature above the sixth threshold, but below a seventh threshold, or a transmission oil temperature above engine coolant temperature by a predetermined amount and engine coolant temperature below the sixth threshold. In such an example, routing coolant flow from the engine, through each of the bypass line, the heater core, the transmission oil cooler, the automatic transmission warmup heat exchanger, the oil cooler, and the degas bottle may include the third thermostat valve in the seventh position and the actuatable solenoid valve in an open position.

The method illustrated in FIG. 4 may further comprise routing coolant flow from the engine, through each of the bypass line, the heater core, the transmission oil cooler, the automatic transmission warmup heat exchanger, the oil cooler, the degas bottle, and a radiator, in an eighth condition, prior to returning to the engine, responsive to engine coolant temperature above the seventh threshold but below an eighth threshold. In such an example, routing coolant flow from the engine, through each of the bypass line, the heater core, the transmission oil cooler, the automatic transmission warmup heat exchanger, the oil cooler, the degas bottle, and the radiator may include the third thermostat valve in an eighth position and the actuatable solenoid valve in the open position. Still further, the method illustrated in FIG. 4 may comprise routing coolant flow from the engine, through each of the heater core, the transmission oil cooler, the automatic transmission warmup heat exchanger, the oil cooler, the degas bottle, and the radiator, but where coolant flow through the bypass line is prevented, in a ninth condition, prior to returning to the engine, responsive to engine coolant temperature above the eighth threshold. In such an example, routing coolant flow from the engine, through each of the heater core, the transmission oil cooler, the automatic transmission warmup heat exchanger, the oil cooler, the degas bottle, and the radiator may include the third thermostat valve in the ninth position and the actuatable solenoid valve in the open position.

Figure 5:
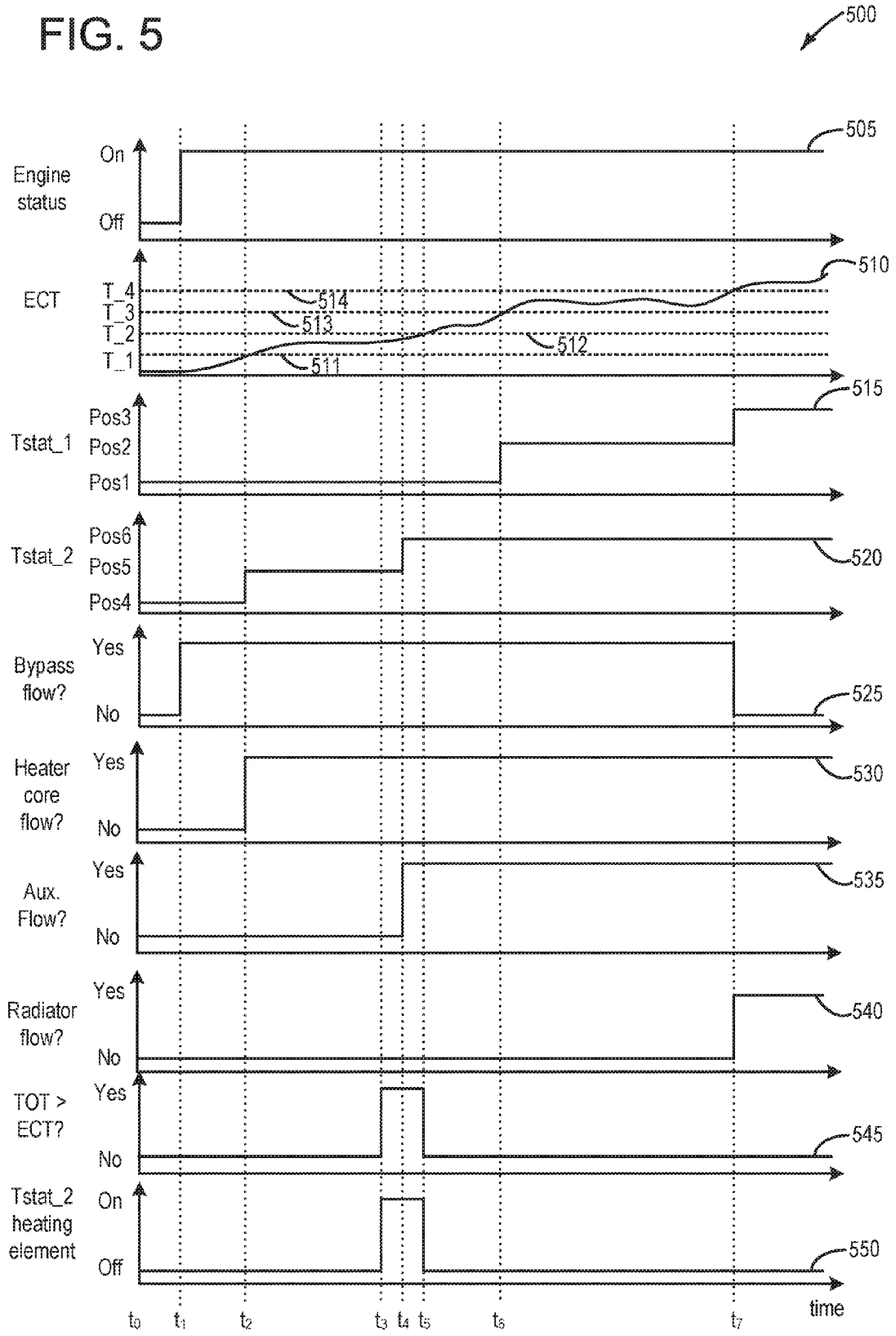
FIG. 5 shows an example timeline for controlling coolant flow in a vehicle cooling system during an engine startup event, according to the method depicted in FIG. 2.
Figure 6:
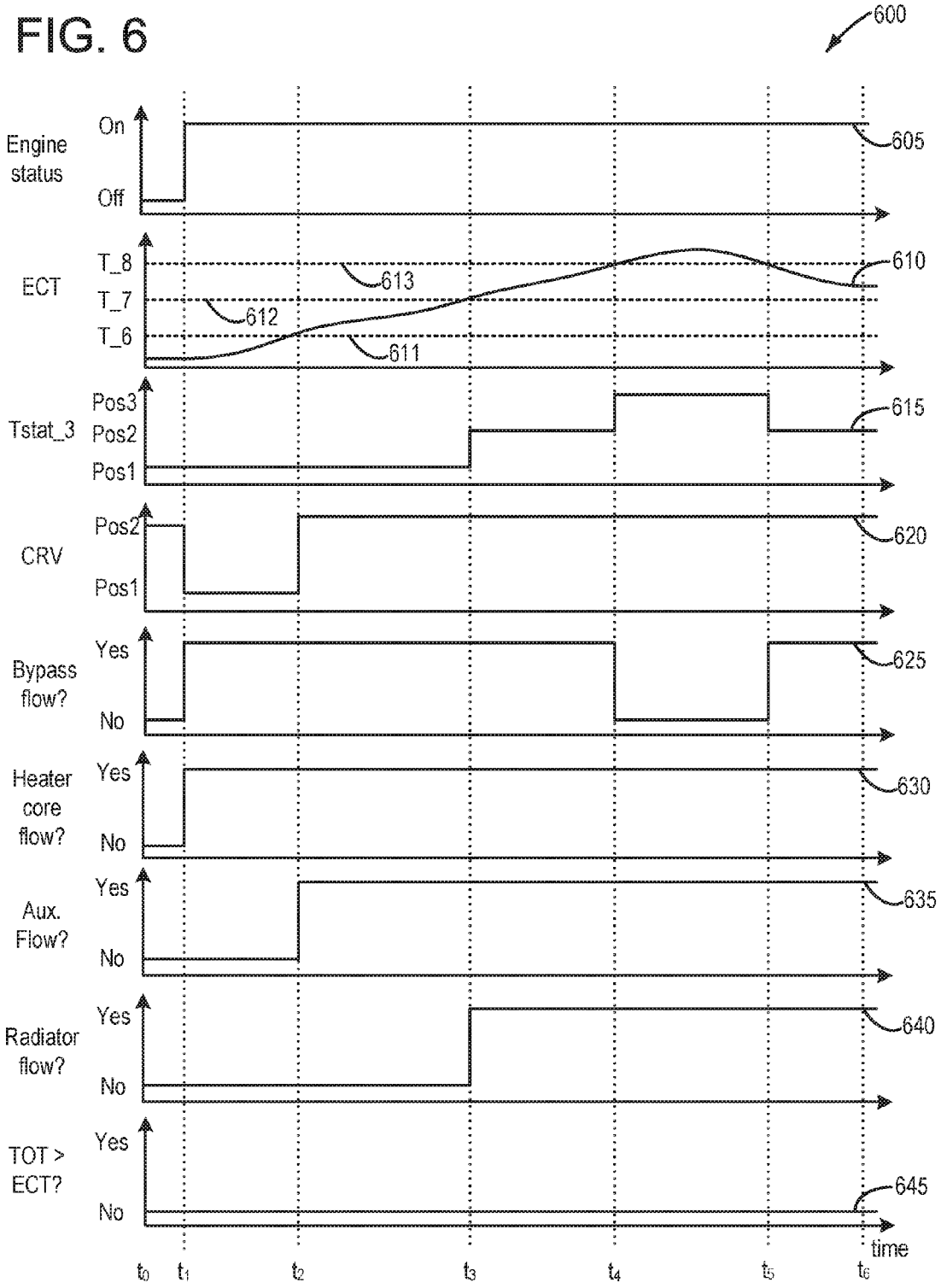
FIG. 6 shows an example timeline for controlling coolant flow in a vehicle cooling system during an engine startup event, according to the method depicted in FIG. 4.

An example timeline for controlling coolant flow through a vehicle system at an engine startup event, according to the method depicted in FIG. 2, is illustrated in FIG. 5. An example timeline for controlling coolant flow through a vehicle system at an engine startup event, according to the method depicted in FIG. 4, is illustrated in FIG. 6.

FIG. 1 shows an example embodiment of a vehicle system 100 including a vehicle cooling system 101 in a motor vehicle 102. Vehicle 102 has drive wheels 106, a passenger compartment 104 (herein also referred to as a passenger cabin), and an under-hood compartment 103. Under-hood compartment 103 may house various under-hood components under the hood (not shown) of motor vehicle 102. For example, under-hood compartment 103 may house internal combustion engine 10. Internal combustion engine 10 has a combustion chamber which may receive intake air via intake passage 44 and may exhaust combustion gases via exhaust passage 48. Engine 10 as illustrated and described herein may be included in a vehicle such as a road automobile, among other types of vehicles. While the example applications of engine 10 will be described with reference to a vehicle, it should be appreciated that various types of engines and vehicle propulsion systems may be used, including passenger cars, trucks, etc.

Cooling system 101 may circulate coolant through internal combustion engine 10 to absorb waste heat, and may distribute the heated coolant to radiator 80, heater core 90, exhaust gas recirculation (EGR) cooler 31, turbo center housing 32, urea injector 33, transmission oil cooler 125, automatic transmission warm-up (ATWU) heat exchanger 34, engine oil cooler 35, and coolant degas bottle 37. In one example, cooling system 101 may be coupled to engine 10 and may circulate engine coolant from engine 10 to the various components described above via engine-driven water pump 86, and back to engine 10 via various coolant lines, as will be discussed in further detail below. An engine coolant temperature (ECT) sensor 26 may be coupled to engine 10, and may be configured to measure the temperature of engine coolant. Readings from ECT sensor 26 may then be communicated to an engine controller 12. Engine-driven water pump 86 may be coupled to the engine via front end accessory drive (FEAD) 36, and rotated proportionally to engine speed via a belt, chain, etc. (illustrated by line 5). Specifically, engine-driven pump 86 may circulate coolant through passages in the engine block, head, etc., to absorb engine heat, which is then transferred via the radiator 80 to ambient air. In one example, where pump 86 is a centrifugal pump, the pressure (and resulting flow) produced by the pump may be increased with increasing crankshaft speed, which in the example of FIG. 1, may be directly linked to the engine speed. As will be discussed in further detail below, coolant may be selectively circulated to the various components based on vehicle operating conditions and coolant temperature.

The temperature of the coolant, and coolant flow path(s) may be regulated at least in part by a first thermostat 38. First thermostat 38 may include a temperature sensing element 41, such as a wax element, for example. Further, first thermostat 38 may include a first thermostat valve 42 located at a junction between coolant lines 82, 83, and 84. Based on a temperature of the coolant as sensed by the temperature sensing element 41, first thermostat valve 42 may be in one of three positions. For example, in a first position, first thermostat valve 42 may enable coolant to flow from coolant line 82, into coolant line 83 (also referred to herein as bypass line 83), while preventing coolant flowing from coolant line 82 to coolant line 84. In a second position, first thermostat valve 42 may enable coolant to flow from coolant line 82 into both bypass line 83 and coolant line 84. Thus, in the second position, coolant may be enabled to flow through the bypass line 83 in addition to enabling coolant to flow to the radiator 80. In a third position, first thermostat valve 42 may enable coolant to flow from coolant line 82 to coolant line 84, while preventing coolant flowing into bypass line 83.

One or more blowers (not shown) and cooling fans may be included in cooling system 101 to provide airflow assistance and augment a cooling airflow through the under-hood components. For example, cooling fan 92, coupled to radiator 80, may be operated to provide cooling airflow assistance through radiator 80. Cooling fan 92 may draw a cooling airflow into under-hood compartment 103 through an opening in the front-end of vehicle 102, for example, through grill shutter system 112. Such a cooling air flow may then be utilized by radiator 80 and other under-hood components (e.g., fuel system components, batteries, etc.) to keep the engine and/or transmission cool. Further, the air flow may be used to reject heat from a vehicle air conditioning system. Further still, the airflow may be used to improve the performance of a turbocharged/supercharged engine that is equipped with intercoolers that reduce the temperature of the air that goes into the intake manifold/engine. In one example, grill shutter system 112 may be configured with a plurality of louvers (or fins, blades, or shutters) wherein a controller may adjust a position of the louvers to control an airflow through the grill shutter system.

Cooling fan 92 may be coupled to, and driven by, engine 10, via alternator 72 and system battery 74. Cooling fan 92 may also be mechanically coupled to engine 10 via an optional clutch (not shown). During engine operation, the engine-generated torque may be transmitted to alternator 72 along a drive shaft (not shown). The generated torque may be used by alternator 72 to generate electrical power, which may be stored in an electrical energy storage device, such as system battery 74. Battery 74 may then be used to operate an electric cooling fan motor 94.

Vehicle system 100 may further include a transmission 40 for transmitting the power generated at engine 10 to vehicle wheels 106. Transmission 40, including various gears and clutches, may be configured to reduce the high rotational speed of the engine to a lower rotational speed of the wheel, while increasing torque in the process. To enable temperature regulation of the various transmission components, cooling system 101 may also be communicatively coupled to a transmission cooling system 45. The transmission cooling system 45 includes a transmission oil cooler 125 (or oil-to-water transmission heat exchanger) located internal or integral to the transmission 40, for example, in the transmission sump area at a location below and/or offset from the transmission rotating elements. Transmission oil cooler 125 may have a plurality of plate or fin members for maximum heat transfer purposes. Coolant from coolant line 85 may communicate with transmission oil cooler 125 via conduit 87. In some examples, a transmission oil temperature (TOT)

sensor 27 may be coupled to transmission 40, and may be configured to monitor temperature of transmission fluid, and communicate the temperature of the transmission fluid to controller 12. In some examples, coolant may flow from the radiator to the transmission oil cooler (not shown).

In some examples, coolant may flow through coolant line 85 to heater core 90 via conduit 81, where the heat may be transferred to passenger compartment 104. Specifically, heater core 90, which may be configured as a water-to-air heat exchanger, may exchange heat with the circulating coolant and transfer the heat to the vehicle passenger compartment 104 based on operator heating demands. As such, heater core may also be coupled to a vehicle HVAC system (or heating, ventilation, and air conditioning system) that includes other components such as a heater fan, and an air conditioner (not shown).

In some examples, coolant may flow through coolant line 85 to engine oil cooler 35. Engine oil cooler 35 may comprise a heat exchanger, in some examples. For example, engine oil may be fed to the engine oil cooler such that the engine oil flows through tubes of the engine oil cooler, while engine coolant flows around the tubes. As such, heat from the oil may be transferred through the walls of the tubes to the surrounding coolant.

In some examples, coolant may flow through coolant line 85 to active transmission warm-up (ATWU) heat exchanger 34, via conduit 88. For example, it may be desirable to heat transmission oil with engine coolant to warm up the transmission oil quickly, such that the transmission pumps oil more easily as compared to when it is cold. For illustrative purposes, oil flow from the transmission 40 into and away from the ATWU heat exchanger 34, is represented by arrows 21. The ATWU heat exchanger 34 may comprise a plate-fin design, as an example. Because the ATWU heat exchanger 34 utilizes engine coolant as the heat exchange fluid, transmission fluid temperature may operate at roughly the equivalent of engine temperature. Furthermore, in some examples, an ATWU bypass valve 22 may be positioned in conduit 88, and may be regulated by a controller 12 in a control system 14. For example, ATWU heat exchanger 34 may in some examples be bypassed (e.g. bypass valve 22 commanded closed). Such examples may include conditions where hot coolant is needed for cabin heating, which may occur at cold ambient temperatures (e.g. close to zero degrees F.). At warmer ambient temperatures, the ATWU bypass valve may be commanded open for transmission oil warming as soon as the transmission is put into drive.

In some examples, coolant may flow through coolant line 82, and to coolant degas bottle 37, via conduit 89. Degas bottle 37 may allow entrained air and gasses in the coolant to be separated from the coolant as the coolant flows through the degas tank. In some examples there may be a vent line 191 from radiator 80 to degas bottle 37. A vent line check valve 190 may be included in vent line 191 in some examples, to prevent air from being pulled into radiator 80. However, in other examples, vent line 191 and vent line check valve 190 may not be included in cooling system 101. FIG. 1 further shows a control system 14. Control system 14 may be communicatively coupled to various components of engine 10 to carry out the control routines and actions described herein. For example, as shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, vehicle acceleration, vehicle attitude, engine speed, mass airflow through the engine, ambient temperature, intake air temperature, etc.), cooling system sensors (such as coolant temperature, transmission oil temperature, coolant level, coolant level sensor circuit board temperature, cylinder heat temperature, fan speed, passenger compartment temperature, ambient humidity, thermostat output, etc.), and others. Further, controller 12 may communicate with various actuators 18, which may include engine actuators (such as fuel injectors, an electronically controlled intake air throttle plate, spark plugs, etc.), cooling system actuators (such as the various valves of the cooling system), and others. In some examples, the storage medium may be programmed with computer readable data representing instructions executable by the processor for performing the methods described below as well as other variants that are anticipated but not specifically listed.

Furthermore, the temperature of the coolant, and coolant flow path(s), may be regulated at least in part by a second thermostat 61. Second thermostat 61 may include a second temperature sensing element 62, such as a wax element, for example. Second thermostat 61 may further include a second thermostat valve 63, located at a junction between coolant lines 81*a*, 83, 84*a*, and 24*a*. As illustrated, coolant line 24*a* may receive coolant flow from one or more of coolant lines 87*a*, 85*a*, and 89*a*. Second thermostat valve 63 may be configured in a fourth position, wherein coolant may be enabled to return to pump 86 via coolant line 83 and 84*a*, but where coolant flow may be prevented from returning to pump 86 via coolant line 81*a*, and coolant line 24. Second thermostat valve 63 may further be configured in a fifth position, wherein coolant may be enabled to return to pump 86 via coolant line 83, 84*a*, and via coolant line 81*a*, but wherein coolant flow may be prevented from returning to pump 86 via coolant line 24. Second thermostat valve 63 may additionally be configured in a sixth position, wherein coolant may be enabled to return to pump 86 via coolant line 83, coolant line 81*a*, coolant line 84*a*, and coolant line 24. Furthermore, second thermostat 61 may comprise an electrically-heated thermostat, where electricity may be provided to second thermostat 61 via an electrical energy storage device, such as system battery 74. For example, in addition to the mechanical function of the wax element, second thermostat 61 may comprise an electric heater 25. Electric heater 25 may be controlled by the vehicle controller 12, where the controller may receive information on engine speed, load, transmission oil temperature (TOT), etc. Said another way, a data set, or "map", may be stored at the controller, which may dictate when and how heat is added to the electrically-heated thermostat to ensure optimal engine performance. Herein, control over the electric heating of second thermostat 61 may be referred to as map-controlled electric heating of second thermostat 61. Still further, a position sensor 28 may be coupled to second thermostat valve 63, such that an accurate indication of what position the valve is in, can be communicated to the vehicle controller.

As will be discussed in greater detail below, by positioning conventional first thermostat 38 at the junction between coolant lines 82, 83, and 84, and by positioning electrically-heated second thermostat at the junction between coolant lines 83, 84*a*, 81*a*, and 24, rapid warm-up of coolant and other powertrain fluids may be achieved through cooling circuit isolation, rather than engine coolant stagnation. Furthermore, cooling circuit isolation may be accomplished without the use of expensive electric valves, by making use of inexpensive wax element thermostats.

Coolant flow through the system depicted in FIG. 1 will be briefly described here, and will be elaborated in further detail below with regard to method 200 depicted in FIG. 2. Specifically, the description that follows includes coolant flow that is relevant to the present disclosure. However, it may be understood that the examples below are not meant to be limiting.

With first thermostat valve 42 positioned in the first position, and second thermostat valve configured in the fourth position, coolant may be enabled to flow from engine 10, to each of at least EGR cooler 31, turbo center housing 32, and urea injector 33. Coolant may proceed to flow through coolant line 82 and 83, through the second thermostat valve 63 configured in the fourth position, and may then return to pump 86 via coolant line 24*b*. Coolant may then be pumped through coolant line 24*c* to return the coolant to engine 10.

With first thermostat valve 42 in the first position, and second thermostat valve 63 in the fifth position, coolant may be enabled to flow from engine 10, to each of at least EGR cooler 31, turbo center housing 32, and urea injector 33. Coolant may proceed to flow through coolant line 85 and to heater core 90 via coolant line 81. After flowing through heater core 90, coolant may flow through coolant line 81*a*, through second thermostat valve 63 configured in the fifth position, to the pump, via coolant line 24*b*. Coolant may then be pumped through coolant line 24*c* to return the coolant to engine 10. Furthermore, coolant may additionally flow through bypass line 83, as discussed above for a condition where first thermostat valve 42 is in the first position.

With first thermostat valve 42 in the first position, and second thermostat valve 63 in the sixth position, coolant may be enabled to flow from engine 10, to each of at least EGR cooler 31, turbo center housing 32, and urea injector 33. Coolant may proceed to flow through heater core 90, via coolant lines 85, 81, and 81*a*, as discussed above. Coolant may additionally proceed to flow through coolant line 85 and coolant line 87, to transmission oil cooler 125. After flowing through transmission oil cooler 125, coolant may flow through coolant line 87*a* and coolant line 24*a*. Furthermore, coolant may flow from coolant line 85, through coolant line 88 to ATWU heat exchanger 34. After flowing through ATWU heat exchanger 34, coolant may flow through coolant line 88*a*, through oil cooler 35, through coolant line 85*a*, and through coolant line 24*a*. Coolant may additionally flow through coolant line 85, through oil cooler 35, and then may proceed through coolant line 85*a* and 24*a*. Still further, coolant may flow through coolant line 82, and through coolant line 89 to degas bottle 37. After flowing through degas bottle 37, coolant may flow through coolant line 89*a*, and coolant line 24*a*. Thus, it may be understood that coolant line 24*a* receives coolant flow returning from transmission oil cooler 125, ATWU heat exchanger 34, oil cooler 35, and degas bottle 37. Coolant flowing in coolant lie 24*a* may then flow through second thermostat valve 63, and through coolant line 24*b*, to pump 86. Coolant may then be pumped through coolant line 24*c* to return the coolant to engine 10. Furthermore, coolant may additionally flow through bypass line 83, as discussed above for a condition where first thermostat valve 42 is in the first position.

With first thermostat valve 42 in the second position, and second thermostat valve in the sixth position coolant may flow as described above with regard to the second thermostat valve in the sixth position. For example, coolant may flow through each of heater core 90, transmission oil cooler 125, ATWU heat exchanger 34, oil cooler 35, and degas bottle 37. However, by configuring the first thermostat valve in the second position, coolant may additionally flow through both bypass line 83, as discussed above, and may additionally flow through the radiator. More specifically, coolant may additionally flow through coolant line 82, through first thermostat valve 42, through coolant line 84, and through radiator 80. After flowing through radiator 80, coolant may return to second thermostat valve 63 via coolant line 84*a*. With first thermostat valve positioned in the second position, coolant may additionally flow through coolant line 82, through first thermostat valve, through bypass line 83, to return to second thermostat valve 63. With second thermostat valve configured in the sixth position, coolant flow from lines 84*a* and 83 may flow through second thermostat valve, through coolant line 24*b*, to pump 86. Coolant may then be pumped through coolant line 24*c* to engine 10. Thus, with first thermostat valve configured in the second position, and second thermostat valve configured in the sixth position, an entire volume of coolant may be flowing through the vehicle cooling system.

Finally, with first thermostat valve 42 in the third position, and second thermostat valve in the sixth position, coolant flow may be substantially the same as that described above for first thermostat valve in the second position, and second thermostat valve in the sixth position, with the exception that coolant flow may be prevented from flowing through bypass line 83 via the first thermostat valve being positioned in the third position.

As will be discussed in further detail below, by configuring first thermostat valve 42 and second thermostat valve 63 in the various combinations as discussed above, coolant flow may be regulated during a vehicle engine startup event, such that coolant may be rapidly warmed without stagnating coolant flow at the engine.

For example, a system for a vehicle may include a coolant system configured to circulate coolant through an engine, an EGR cooler, a turbo center housing, a urea injector, a bypass line, a radiator, a heater core, and an auxiliary loop. The system may further include a first thermostat with a first thermostat valve and a first temperature sensing element, positioned on a hot-side of the engine, and configured to receive coolant from the engine and to direct coolant through the bypass line in a first position, through the bypass line and the radiator in a second position, and through the radiator but not the bypass line in a third position. The system may further include a second thermostat with a second thermostat valve and a second temperature sensing element positioned on a cold-side of the engine, and configured to receive coolant from the bypass line in a fourth position, from the bypass line and the heater core in a fifth position, and from the bypass line, heater core, radiator, and auxiliary loop in a sixth position. The system may further include a pump configured to circulate the coolant, the pump positioned in a coolant line between the engine and the second thermostat, and wherein the coolant system is configured such that the EGR cooler, the turbo center housing, and the urea injector receive coolant flow when the engine is operating and when the first thermostat is in any of the first through third positions, and when the second thermostat is in any of the fourth through sixth positions.

In such a system for a vehicle, the first thermostat valve may be configured in the first position and the second thermostat valve may be configured in the fourth position responsive to engine coolant temperature below a first threshold. In another example, the first thermostat valve may be configured in the first position and the second thermostat valve may be configured in the fifth position responsive to engine coolant temperature above the first threshold, but below a second threshold. Another example may comprise the first thermostat valve configured in the first position and the second thermostat valve configured in a sixth position responsive to engine coolant temperature above the second threshold, but below a third threshold. In such examples, the first thermostat valve may be configured in the second position and the second thermostat valve may be configured in the sixth position responsive to engine coolant temperature above the third threshold, but below a fourth threshold. Alternatively, the first thermostat valve may be configured in a third position and the second thermostat valve may be configured in the sixth position responsive to engine coolant temperature above the fourth threshold.

Such a system may further comprise an electric heater configured to raise a temperature of the second thermostat; a transmission oil temperature sensor; an engine coolant temperature sensor. The system may further comprise a controller, storing instructions in non-transitory memory, that when executed, cause the controller to monitor transmission oil temperature and engine coolant temperature. Responsive to transmission oil temperature above engine coolant temperature by a predetermined amount, and further responsive to engine coolant temperature below the second threshold, the electric heater may be activated to raise the temperature of the second thermostat to a temperature above the second threshold, to configure the second thermostat in the sixth position. Furthermore, for the above-described system, the auxiliary loop may include at least a transmission oil cooler, an automatic transmission warmup heat exchanger, an oil cooler, and a degas bottle.

Turning now to FIG. 2, a high level flowchart for an example method 200 for rapid coolant warm-up during an engine start-up event, is shown. More specifically, a first thermostat and a second thermostat may be positioned in an engine coolant system, such that engine coolant and other powertrain fluids may be rapidly warmed through cooling circuit isolation rather than engine coolant stagnation. The first thermostat may comprise a wax element thermostat, and the second thermostat may comprise an electrically-heated thermostat. For example, the method may comprise during a first condition, flowing a first, smaller volume of coolant through a vehicle coolant system, the first volume of coolant routed through an engine and a bypass line via a first thermostat valve of a first thermostat positioned on a hot side of the engine being in a first position and a second thermostat valve of a second thermostat positioned on a cold side of the engine being in a fourth position. During a second condition, the method may include flowing a second, larger volume of coolant through the vehicle coolant system, the second volume of coolant routed through the engine, the bypass line, and through a heater core via the first thermostat valve in the first position and the second thermostat valve in a fifth position. The first condition may include an engine coolant temperature below a first threshold, and the second condition may include engine coolant temperature above the first threshold, but below a second threshold.

The method may further include, during a third condition, flowing a third volume of coolant, larger than the second volume, through the vehicle coolant system, the third volume of coolant routed through the engine, the bypass line, the heater core, and an auxiliary loop, via the first thermostat valve in the first position and the second thermostat valve in a sixth position. Routing coolant through the auxiliary loop may include flowing coolant through one or more of a transmission oil cooler, an automatic transmission warm-up heat exchanger, an oil cooler, and a degas bottle. Furthermore, the third condition may include engine coolant temperature above the second threshold, but below a third threshold. Furthermore, the method may include monitoring a transmission oil temperature via a transmission oil temperature sensor. For example, the third condition may include a transmission oil temperature greater than engine coolant temperature by a predetermined amount, and engine coolant temperature below the second threshold. In such an example, the method may include actively raising a temperature of the second thermostat via an electric heater coupled to the second thermostat, wherein actively raising the temperature of the second thermostat includes actively raising the temperature to configure the second thermostat valve in the sixth position.

The method may further include, during a fourth condition, flowing a fourth volume of coolant, larger than the third volume, through the vehicle coolant system, the fourth volume of coolant routed through the engine, the bypass line, the heater core, the auxiliary loop, and the radiator, via the first thermostat valve in a second position, and the second thermostat valve in the sixth position. The fourth condition may include engine coolant temperature above the third threshold, but below a fourth threshold, and wherein the fourth volume of coolant comprises an entire volume of coolant in the vehicle cooling system. Still further, during a fifth condition, the method may include flowing a fifth volume of coolant, smaller than the fourth volume, through the vehicle coolant system. The fifth volume of coolant may be routed through the engine, the heater core, the auxiliary loop, and the radiator, but coolant flow may be prevented from flowing through the bypass line, via the first thermostat in a third position, and the second thermostat valve in the sixth position, and wherein the fifth condition includes engine coolant temperature above the fourth threshold.

Method 200 will be described with reference to the systems described herein and shown in FIG. 1, though it should be understood that similar methods may be applied to other systems without departing from the scope of this disclosure. Parts of method 200 may be carried out by a controller, such as controller 12 in FIG. 1, and may be stored at the controller as executable instructions in non-transitory memory. Instructions for carrying out method 200 and the rest of the methods included herein may be executed at least in part by the controller based on instructions stored on a memory of the controller and in conjunction with signals received from sensors of the engine system, such as the sensors described above with reference to FIG. 1. The controller may employ coolant system actuators, such as second thermostat electric heater (e.g. 25), etc., according to the methods depicted below.

Method 200 begins at 205, and may include evaluating operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 210, method 200 may include indicating whether engine coolant temperature is below a first threshold. For example, engine coolant temperature (ECT) may be monitored via an engine coolant temperature sensor (e.g. 26). ECT below the first threshold may comprise a temperature of coolant at a cold-start of the vehicle, as an example. A cold-start of the vehicle may include an engine start after a threshold duration of time has elapsed since the engine was last turned off, for example. In another example, engine coolant temperature below the first threshold may comprise an engine coolant temperature below an exhaust catalyst light-off temperature. If, at 210, it is indicated that ECT is not below the first threshold, it may be that engine coolant temperature is above the first threshold, but below a second threshold, or above a second threshold, but below a third threshold, etc. Thus, it may be understood that, if ECT is not below the first threshold, then the engine may have been operating for a duration wherein engine coolant has warmed to a temperature above the first threshold. Another example may include a vehicle engine hot start, where engine coolant temperature is above the first threshold at engine start, where a temperature of one or more exhaust catalysts is above a light-off temperature, where a time since a last engine start is below a preselected time, etc. Accordingly, if, at 210, it is indicated that ECT is not below the first threshold, then method 200 may include determining whether ECT is above the first threshold, or above a second, third, or fourth threshold, each of which will be discussed in further detail below. As such, a dotted line is illustrated in method 200, proceeding from step 210, to any of steps 220, 230, 240, or 250. Details regarding each of the steps, and control mechanisms for regulating coolant flow depending on ECT, will be discussed in detail below.

If, at 210, it is indicated that ECT is below the first threshold, method 200 may proceed to 215. At 215, method 200 may include first thermostat (e.g. 38) configured in a first position, and second thermostat (e.g. 61) configured in a fourth position. More specifically, because ECT is below the first threshold, a first thermostat valve (e.g. 42) may be configured in the first position, without input from the vehicle controller. For example, a wax element associated with the first thermostat may be substantially in a solidified form as a result of temperature of the coolant below the first threshold, and as such, first thermostat valve may be configured in the first position. With first thermostat valve configured in the first position, coolant may be enabled to flow from the engine, to bypass line (e.g. 83), but may be prevented from additionally flowing through a conduit (e.g. 84) to the radiator. Furthermore, a second thermostat valve (e.g. 63) may be configured in the fourth position. It may be understood that, while second thermostat may comprise an electrically-heated thermostat, external heating of the second thermostat electric heater (e.g. 25) associated with the second thermostat may not be conducted to configure second thermostat in the fourth position. Thus, second thermostat valve may reside in a default position in the fourth position, without input from the vehicle controller. In the fourth position, second thermostat valve may enable return of coolant flow from the bypass line (e.g. 83) and coolant flow from the radiator (e.g. via coolant line 84*a*). However, because the first thermostat valve is in the first position, coolant may not be flowing through to the radiator. Furthermore, second thermostat valve configured in the fourth position may prevent return of coolant flow from conduits stemming from a heater core (e.g. 90), transmission oil cooler (e.g. 125), engine oil cooler (e.g. 35), ATWU heat exchanger (e.g. 34), and degas bottle (e.g. 37). As such, with ECT below the first threshold, coolant may flow from the engine (e.g. 10), through bypass line (e.g. 83), through the second thermostat valve configured in the fourth position, and may then return to the pump (e.g. 86). Furthermore, en route to the bypass line, coolant may flow to one or more of at least an EGR cooler (e.g. 31), a turbo center housing (e.g. 32), and a urea injector (e.g. 33), where the vehicle system includes such components.

As discussed, with second thermostat valve configured in the fourth position, coolant flow described with regard to step 215 may return to the pump (e.g. 86), to be pumped back through the engine. Furthermore, because return flow of coolant from the heater core, transmission oil cooler, engine oil cooler, ATWU heat exchanger, and degas bottle may be prevented via second thermostat valve in the fourth position, coolant may only be allowed to flow from the engine through the bypass line (and through other components such as EGR cooler, turbo center housing, urea injector), and back to the engine, while being additionally prevented from circulating to the radiator via the first thermostat valve in the first position. By limiting coolant to flow from the engine to the bypass line (e.g. limiting coolant flow to only the bypass line), and back to the engine, coolant may be rapidly heated, without stagnating the coolant at the engine. By preventing coolant stagnation at the engine, uneven heating of various engine components may be avoided. Furthermore, it may be understood that configuring the first thermostat valve in the first position, and the second thermostat valve in the fourth position, may be carried out without input from the vehicle controller. Rather, ECT as sensed by the first temperature sensing element (e.g. 41), and the second temperature sensing element (e.g. 62), may result in the first thermostat valve adopting the first position, and the second thermostat valve adopting the fourth position.

Proceeding to step 220, method 200 may include indicating whether ECT is above the first threshold. For example, ECT above the first threshold (but below a second threshold) may comprise an ECT at which a thermostat associated with enabling return flow from a heater core (e.g. 90) is desired to open. If, at 220, it is indicated that ECT is not greater than the first threshold, method 200 may return to step 215, and may include maintaining the first thermostat valve in the first position, and maintaining the second thermostat valve in the fourth position. Alternatively, if at step 220 ECT is indicated to be greater than the first threshold, method 200 may proceed to step 225.

At step 225, method 200 may include maintaining the first thermostat in the first position, whereas the second thermostat may adopt a fifth position. As discussed above, and as indicated at FIG. 1, return flow from the heater core (e.g. 90) may be controlled by the second thermostat, wherein the second thermostat may comprise an electrically-heated thermostat, with a second temperature sensing element (e.g. 62). Thus, in some examples, the second temperature sensing element may be configured to position second thermostat valve (e.g. 63) in the fifth position, responsive to ECT crossing the first threshold. In the fifth position, second thermostat valve may enable coolant to return from a heater core (e.g. 90) to the pump (e.g. 86), and back to the engine (e.g. 10). More specifically, with regard to FIG. 1, when ECT reaches the first threshold, engine coolant may be enabled to flow from the engine, through one or more of at least an EGR cooler (e.g. 31), a turbo center housing (e.g. 32), and a urea injector (e.g. 33), and to the heater core, via coolant lines (e.g. coolant line 85 and coolant line 81). Coolant leaving from the heater core, may return to the pump (e.g. via coolant line 81*a*) by passing through the second thermostat, where the second thermostat valve may be configured in the fifth position.

Furthermore, at step 225, ECT may be below a temperature that may result in a transition of the first thermostat valve (e.g. 42) from the first position, to a second position (or third position). As such, with ECT>the first threshold (but below the second threshold), coolant may circulate to both the heater core, via the second thermostat valve being configured in the fifth position, and the bypass line (e.g. 83), via the first thermostat valve (e.g. 42) being in the first position. However, coolant may be prevented from circulating to the radiator (e.g. 80), and to the transmission oil cooler (e.g. 125), ATWU heat exchanger (e.g. 34), oil cooler (e.g. 35), and coolant degas bottle (e.g. 37). It may be understood that, at step 225, configuring the first thermostat valve in the first position, and the second thermostat valve in the fifth position, may be carried out without input from the vehicle controller. Rather, ECT as sensed by the first temperature sensing element (e.g. 41), and the second temperature sensing element (e.g. 62), may result in the first thermostat valve adopting the first position, and the second thermostat valve adopting the fifth position.

Proceeding to step 230, it may be determined as to whether ECT is greater than the second threshold. For example, the second threshold may comprise an ECT at which point it is desired to enable coolant flow to one or more of at least the transmission oil cooler, ATWU heat exchanger, oil cooler, and coolant degas bottle. If, at 230, it is indicated that ECT is not greater than the second threshold, method 200 may proceed to step 232. At 232, it may be indicated as to whether transmission oil temperature (TOT) is greater than ECT by a predetermined amount. For example, TOT may be monitored by a TOT sensor (e.g. 27). In some examples, if TOT is greater than ECT by the predetermined amount, then the second thermostat electric heater (e.g. 25) may be activated in order to actively enable coolant flow to at least the transmission oil cooler (e.g. 125), as will be discussed in further detail below. However, if it is indicated at 230 that ECT is not greater than the second threshold, and if it is further indicated at step 232 that TOT is not greater than ECT by the predetermined amount, then method 200 may return to step 225, where the first thermostat valve may be configured in the first position, and the second thermostat valve may be configured in the fifth position. As discussed above, maintaining the first thermostat valve in the first position, and maintaining the second thermostat valve in the fifth position, may be enabled without external control via the vehicle controller (e.g. 12).

If, however, it is indicated at step 232 that TOT is greater than ECT by the predetermined amount, method 200 may proceed to 233. At 233, method 200 may include the vehicle controller sending a signal to the second thermostat electric heater to raise the temperature at the second thermostat to a temperature that may result in the second thermostat valve transitioning from the fifth position, to a sixth position. Accordingly, proceeding to step 234, method 200 may include indicating whether the second thermostat valve is configured in the fifth position, or the sixth position. In some examples, indicating what position the second thermostat valve is in may include the vehicle controller receiving positional information on the second thermostat valve, via a second thermostat valve position sensor (e.g. 28). For example, the second thermostat valve position sensor may monitor position of the second thermostat valve (e.g. whether the second thermostat valve is in the fourth position, fifth position, or sixth position), and may communicate the indicated position of the second thermostat valve to the vehicle controller. Accordingly, at 234, if it is indicated that the second thermostat valve is not in the sixth position, then method 200 may return to 233, and may include continuing to heat the second thermostat via the second thermostat electric heater.

If, at 234, it is indicated that the second thermostat is in the sixth position, as indicated via the second thermostat valve position sensor, method 200 may proceed to 235, where first thermostat valve may be configured in the first position, and where second thermostat valve may be configured in the sixth position. Coolant flow under such conditions, will be described in further detail below.

Alternatively, returning to step 230, if ECT is greater than the second threshold, method 200 may proceed to 235, without the controller actively raising the temperature of the second thermostat to induce a transition in the second thermostat valve from the fifth position to the sixth position. More specifically, as discussed above, the second thermostat may include a wax element, or other temperature sensing element, which may control transitions between various positions of the second thermostat valve. Thus, with engine coolant flowing to the second thermostat valve, when ECT reaches the second threshold, the second thermostat valve may transition from the fifth position to the sixth position.

As such, at 235, with the second thermostat valve configured in the sixth position, coolant may be enabled to return from a common coolant line (e.g. 24*a*) that receives coolant flow from one or more of the transmission oil cooler (e.g. 125), ATWU heat exchanger (e.g. 34), oil cooler (e.g. 35), and degas bottle (e.g. 37). Because return flow from these components to the pump and engine may be enabled via configuring the second thermostat valve in the sixth position, it may be understood that, at the point at which the second thermostat valve adopts the sixth position, coolant may flow from the engine, to the heater core, to the transmission oil cooler, to the ATWU heat exchanger, to the oil coolers, and to the degas bottle. More specifically, transmission oil cooler (e.g. 125) may receive coolant flow from coolant lines stemming from the engine (e.g. coolant line 85 and coolant line 87). Coolant may thus return from the transmission oil cooler to the pump and engine via the second thermostat, by traveling through a coolant line (e.g. 87*a*), that connects to another common coolant line (e.g. 24*a*). It may be understood that common coolant line (e.g. 24*a*) may be referred to as "common" because it may receive coolant return flow from a number of vehicle components, such as the transmission oil cooler, ATWU heat exchanger, oil cooler, and degas bottle.

Coolant may additionally flow to the ATWU heat exchanger (e.g. via coolant lines 85 and 88) from the engine, and may return (e.g. via coolant lines 88*a* and 85*a*) to the pump and engine via the common coolant line (e.g. 24). Similarly, coolant may flow to the oil cooler (e.g. via coolant lines 85, and may return (e.g. via coolant line 85) to the pump and engine via the second thermostat valve configured in the sixth position. Still further, coolant may flow to the degas bottle (e.g. 37) (e.g. via coolant lines 82 and 89), and may return (e.g. via coolant line 89*a*) to the pump and engine via the second thermostat valve configured in the sixth position.

Thus, at 235, coolant flow through the vehicle system may be summarized as being enabled to flow from the engine, to one or more of at least the EGR cooler (e.g. 31), turbo center housing (e.g. 32), and urea injector (e.g. 33), and may be further enabled to flow to the heater core (e.g. 90), transmission oil cooler, ATWU heat exchanger, oil cooler, and degas bottle. Coolant may be further enabled to flow from the engine to the bypass line (e.g. 83). However, coolant may be prevented from flowing to the radiator, due to the first thermostat valve being positioned in the first position, as discussed above.

Proceeding to 240, it may be determined as to whether ECT is greater than a third threshold. For example the third threshold may be a threshold temperature at which coolant flow to the radiator may be desirable. If, at 240, engine coolant has not reached the third threshold, method 200 may return to 235, and may include maintaining the first thermostat valve in the first position, and maintaining the second thermostat valve in the sixth position. More specifically, as discussed above, because ECT is below the third threshold, a temperature sensing element (e.g. 41), such as a wax element, may sense the ECT, and where ECT is below the third threshold, a transition of the first thermostat valve from a first position to a second position may not be enabled. With ECT below the third threshold, the first thermostat valve may thus be maintained in the first position, without external input from the vehicle controller, as discussed above.

Alternatively, if, at 240, it is indicated that ECT is greater than the third threshold, method 200 may proceed to 245. At 245, method 200 may include maintaining the second thermostat valve in the sixth position, and may further include configuring the first thermostat valve in the second position. More specifically, because ECT has reached the third threshold, coolant flowing to the first thermostat may be sensed by the temperature sensing element associated with the first thermostat, and as such, the first thermostat valve may be induced to transition from the first position, to the second position. Furthermore, because the first thermostat valve may be induced to transition from the first position, to the second position, based solely on the temperature of the ECT as sensed by the temperature sensing element, configuring the second thermostat valve in the second position may occur without external input from the vehicle controller.

Thus, at 245, it may be understood that an entire volume of coolant may be flowing through the vehicle coolant system. More specifically, by configuring the first thermostat valve in the second position, coolant may be enabled to flow from the engine, to one or more of at least the EGR cooler (e.g. 31), turbo center housing (e.g. 32), and urea injector (e.g. 33), and may be further enabled to flow to through the first thermostat valve (e.g. via coolant lines 82 and 84), to the radiator (e.g. 80), before returning to the pump and engine (e.g. via coolant lines 84*a*). Coolant flow may additionally be enabled to flow through the bypass line (e.g. 83), before returning to the pump and engine. As such, it may be understood that coolant flow may be blended between the radiator and the bypass line, responsive to the first thermostat being configured in the second position. Furthermore, with the second thermostat valve being configured in the sixth position, coolant return flow from the each of the heater core, transmission oil cooler, ATWU heat exchanger, oil cooler, and degas bottle, may be enabled, as discussed above. Thus, the entire volume of coolant may be understood to be flowing through the coolant system, responsive to the first thermostat valve being in the second position, and the second thermostat valve being configured in the sixth position.

Proceeding to step 250, it may be determined as to whether ECT is above a fourth threshold. In some examples, the fourth threshold may comprise a threshold ECT, where additional cooling of the coolant may be desirable. As discussed above, the temperature sensing element (e.g. wax element) of the first thermostat valve may sense coolant temperature. Thus, if the temperature of coolant circulating through the first thermostat is not above the fourth threshold, method 200 may return to 245, and may include maintaining the first thermostat in the second position, and maintaining the second thermostat in the sixth position. However, if temperature of the coolant circulating through the first thermostat is above the fourth threshold, method 200 may proceed to 255.

At 255, method 200 may include configuring the first thermostat valve in a third position, and maintaining the second thermostat valve in the sixth position. More specifically, because ECT sensed by the first thermostat temperature sensing element is above the fourth threshold, the first thermostat valve may transition from the second position, to a third position. Furthermore, the first thermostat valve may transition from the second position to the third position without external input from the vehicle controller. Similarly, the second thermostat valve may be maintained in the sixth position, without external input from the vehicle controller.

With the first thermostat valve configured in the third position, coolant flow may be prevented from flowing from the engine, through first thermostat valve, and through the bypass line (e.g. 83). However, with the exception of coolant flow being prevented from flowing through the bypass line, the rest of the volume of coolant in the vehicle cooling system may be understood to be circulating. By preventing flow of coolant through the bypass line, a volume of flow to the radiator may be increased, such that cooling of the engine coolant may be increased.

Proceeding to 260, method 200 may include continuing to control coolant flow throughout the vehicle system as a function of ECT, engine speed, engine load, TOT, etc., for the duration of the drive cycle where the engine is activated. For example, if ECT drops below the fourth threshold, but remains above the third threshold, the first thermostat valve may transition to the second position, and the second thermostat valve may be maintained in the sixth position. Such an example is illustrative, and is not meant to be limiting. For example, there may be conditions wherein ECT drops below the third threshold, but remains above the second threshold, etc.

The method 200 depicted above illustrates an example method for controlling coolant flow in a vehicle cooling system during an engine start-up event, via two thermostats with temperature sensing elements (e.g. wax elements). As described, much of the method may be enabled without external input or regulation via a vehicle controller. However, as indicated, there may be circumstances where control over valve opening may be desirable. Such circumstances may include conditions wherein TOT is greater than ECT by a predetermined amount, wherein actively inducing the second thermostat valve to transition from one position to another may prevent vehicle components from overheating, as an example. For clarity, such an example is illustrated above with regard to method 200 as being responsive to ECT below the second threshold. However, such an example is not meant to be limiting. Instead, it may be understood that the vehicle controller may command the electric heater to induce the second thermostat valve to transition from one position to another, at steps prior to the step illustrated at 230, without departing from the scope of the present disclosure. For example, the electric heater may be utilized to induce a transition from the fourth position to the fifth position, under some vehicle operating conditions. Such conditions may include TOT greater than ECT, for example, and may further be based on engine speed and load, for example. While not explicitly illustrated, the second thermostat valve may similarly be induced to transition from the fifth position to the sixth position based on engine speed and load, in addition to whether TOT is greater the ECT by the predetermined amount. For example, a data set, or map, may be stored at the controller, as discussed above, which may dictate when and how heat is added to the electrically-heated second thermostat to ensure optimal performance. Thus, while method 200 depicts electrically-heating the second thermostat responsive to ECT less than the second threshold, and further responsive to TOT>ECT, it may be understood that such an example is not meant to be limiting. Rather, heat may be supplied to the thermostat to ensure optimal performance at any point during a drive cycle (e.g. during method 200), based on engine load, speed, TOT, etc.

As discussed, method 200 illustrates an example wherein coolant flow through the vehicle coolant system may be regulated via two thermostat valves, strategically positioned in the vehicle coolant system. As such, coolant flow may be isolated at an engine startup event such that warming of the engine coolant may be rapidly achieved, without coolant stagnation at the engine, which may thus prevent durability issues associated with uneven heating of engine components, etc. Furthermore, the second thermostat may be optionally electrically heated, affording active control over which position the second thermostat valve may be configured in. As such, depending on temperature of engine coolant in relation to transmission oil temperature, and further depending on engine speed and load, the electrically heated second thermostat valve may be induced to change valve position, such that optimal engine performance may be achieved during a drive cycle.

In another example, rather than two thermostats, one thermostat (herein referred to as a third thermostat to differentiate the third thermostat from the first and second thermostats described above), and one actuatable valve (e.g. solenoid valve), where the actuatable valve is not associated with the third thermostat (e.g. actuatable valve is separate from the third thermostat), may enable coolant flow to be regulated in a vehicle coolant system similar to that described above with regard to FIG. 1 and the method depicted in FIG. 2. Such a system is illustrated in FIG. 3, and a method for controlling the system illustrated in FIG. 3, is depicted in FIG. 4.

Turning now to FIG. 3, a vehicle system 300, including a vehicle cooling system 301, is shown. It may be understood that many of the components illustrated in vehicle cooling system 301 may comprise the same components as those illustrated in vehicle cooling system 101 depicted at FIG. 1. Thus, for brevity, components that are common between FIG. 1 and FIG. 3 are represented by the same numerical designation, and as such, an in-depth description of all components with like numerals will not be reiterated herein.

Briefly, as indicated above, a main difference between the vehicle cooling system 101 and vehicle system 301 is the inclusion of only one thermostat in vehicle cooling system 301 as compared to vehicle cooling system 101, and the inclusion of an actuatable solenoid valve 310 in vehicle cooling system 301. Herein, actuatable solenoid valve 310 may additionally be referred to as coolant return valve (CRV) 310. As described above, vehicle cooling system 301 may include a third thermostat 305. It may be understood that third thermostat 305 may be substantially similar to first thermostat 38 depicted at FIG. 1. For example, third thermostat 305 may include a temperature sensing element 307, such as a wax element, for example. Further, third thermostat 305 may include a third thermostat valve 306. Based on a temperature of the coolant as sensed by the temperature sensing element 307, third thermostat valve 306 may be in one of three positions, described in more detail below. However, instead of being positioned at a junction between coolant lines 82, 83, and 84, like first thermostat 38 in FIG. 1, third thermostat may be positioned at a junction between coolant lines 81*b*, 83*b*, 84*d*, and 24*e*. More specifically, third thermostat may be positioned at a junction where coolant lines returning from a heater core 90 (e.g. via coolant line 81*b*), from a radiator 80 (e.g. via coolant lines 84*d*), from a transmission oil cooler 125 (e.g. via coolant lines 87*b*, 24*d*, and 24*e*), from an ATWU heat exchanger 34 (e.g. via coolant lines 88*a*, 85*b*, 24*d* and 24*e*), from an oil cooler 35 (e.g. via coolant lines 85*b*, 24*d* and 24*e*), and from a degas bottle 37 (e.g. via coolant lines 89*b*, 24*d*, and 24*e*), intersect.

CRV 310 may be positioned between coolant lines 24*d* and 24*e*, between a junction point 311, and the third thermostat 305. The junction point 311 may comprise a junction point where coolant lines returning from transmission oil cooler 125, ATWU heat exchanger 34, oil cooler 35, and degas bottle 37, intersect (e.g. where coolant lines 87*b*, 89*b*, and 85*b* intersect). CRV 310 may comprise an actuatable valve that may be opened and closed responsive to electrical signals received from a vehicle controller 12, wherein the electricity to actuate CRV 310 may be provided via an onboard energy source, such as battery 74.

Pump 86 may be positioned in a conduit between third thermostat 305 and engine 10. Coolant returning to the engine may thus flow through third thermostat valve 306, through coolant line 24*f*, to pump 86. Pump 86 may then pump coolant through coolant line 24*g*, to engine 10.

A brief description of coolant system operation will herein be discussed, and a more detailed methodology will be discussed with regard to FIG. 4. As discussed, third thermostat valve 306 may be configured in one of three positions. Herein, the positions of the third thermostat valve may include a seventh position, an eighth position, and a ninth position. When configured in the seventh position, coolant may be enabled to return to pump 86 from bypass line 83*b* (e.g. via coolant lines 83*b* and 24*f*), and from heater core 90 (e.g. via coolant line 81*b* and 24*f*). However, coolant may be prevented from returning to pump 86 from radiator 80. Return flow from other coolant system components, such as transmission oil cooler 125, ATWU heat exchanger 34, oil cooler 35, and degas bottle 37, may be regulated by CRV 310. Under conditions where CRV 310 is in a first position (e.g. a closed configuration), coolant return flow from such components to pump 86 may be prevented. Alternatively, responsive to CRV 310 being configured in a second position (e.g. an open configuration), coolant return flow from such components may be enabled. It may be understood that, responsive to CRV 310 being configured in the second position, coolant flow may return from one or more of transmission oil cooler 125, ATWU heat exchanger 34, oil cooler 35, and degas bottle 37, regardless of what position the third thermostat valve is in.

With third thermostat valve 306 configured in an eighth position, coolant may be enabled to return to pump 86 from bypass line 83*b* (e.g. via coolant lines 83*b* and 24*f*), from heater core 90 (e.g. via coolant line 81*b* and 24*f*), and from radiator 80 (e.g. via coolant lines 84*d* and 24*f*). Finally, with third thermostat valve 306 configured in a ninth position, coolant may be enabled to return to pump 86 from heater core 90 and from radiator 80, however coolant flow may be prevented from returning from bypass line 83*b*. Said another way, with third thermostat valve 306 configured in the ninth position, third thermostat valve 306 may prevent coolant flow from circulating through bypass line 83*b*, such that additional cooling may be enabled, by preventing coolant from being routed through bypass line 83*b*.

Turning now to FIG. 4, a high level flowchart for an example method 400 for rapid coolant warm-up during an engine start-up event, is shown. More specifically, a third thermostat (e.g. 305) and an actuatable solenoid valve (e.g. CRV 310) may be positioned in an engine coolant system, such that engine coolant and other powertrain fluids may be rapidly warmed through cooling circuit isolation rather than engine coolant stagnation. As an example, the third thermostat may comprise a conventional thermostat (e.g. wax element thermostat), and may be substantially similar to first thermostat (e.g. 38), depicted above at FIG. 1. However, while the first thermostat depicted at FIG. 1 may be positioned on a hot side of the engine, the third thermostat may be positioned on a cold side of the engine, illustrated at FIG. 3. Similarly, the actuatable solenoid valve, herein referred to as coolant return valve (CRV) may be positioned on the cold side of the engine. The third thermostat may receive coolant flowing through the CRV, under vehicle operating conditions wherein the CRV is open. Alternatively, the third thermostat may be prevented from receiving coolant flow through the CRV, under vehicle operating conditions wherein the CRV is closed. As will be discussed in detail below, coolant flow throughout the vehicle cooling system may be regulated by controlling the CRV to be open or closed, and may be further dependent on whether the third thermostat valve is configured in one of three positions. As such, rapid warm-up of engine coolant may be achieved without coolant stagnation at the engine, for example.

Method 400 will be described with reference to the systems described herein and shown in FIG. 3, though it should be understood that similar methods may be applied to other systems without departing from the scope of this disclosure. Parts of method 400 may be carried out by a controller, such as controller 12 in FIG. 3, and may be stored at the controller as executable instructions in non-transitory memory. Instructions for carrying out method 400 and the rest of the methods included herein may be executed at least in part by the controller based on instructions stored on a memory of the controller and in conjunction with signals received from sensors of the engine system, such as the sensors described above with reference to FIG. 3. The controller may employ coolant system actuators, such as CRV (e.g. 310), etc., according to the methods depicted below.

Method 400 begins at 405, and may include evaluating operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 410, method 400 may include indicating whether engine coolant temperature (ECT), as monitored via an engine coolant temperature sensor (e.g. 26), is below a sixth threshold. ECT below the sixth threshold may comprise a temperature of coolant at a cold-start of the vehicle, for example, where a cold-start of the vehicle may include an engine start after a threshold duration of time has elapsed since the engine was last turned off, ECT below an exhaust catalyst light-off temperature, etc. If, at 410, it is indicated that ECT is not below the sixth threshold, it may be that ECT is above the sixth threshold, but below the seventh threshold, or above the seventh threshold, but below an eight threshold, or above the eight threshold, etc. Thus, it may be understood that, if ECT is not below the sixth threshold, then the engine may have been operating for a duration wherein engine coolant may have warmed to a temperature above the sixth threshold. Another example may include a vehicle hot-start, where a temperature of one or more exhaust gas catalysts is above a light-off temperature, where a time since a last engine start is below a preselected time, etc. Accordingly, if, at 410, it is indicated that ECT is not below the sixth threshold, then method 400 may include determining whether ECT is above the sixth threshold, or above a seventh or eighth threshold, each of which will be described in further detail below. As such, a dotted line is illustrated in method 400, proceeding from step 410, to any of steps 420, 430, or 440. Details regarding each of the steps, and control mechanisms for regulating coolant flow depending on ECT, will be discussed in detail below.

If, at 410, it is indicated that ECT is below the sixth threshold, method 400 may proceed to 415. At 415, method 400 may include third thermostat valve (e.g. 306) configured in the seventh position, and CRV (e.g. 310), in a first position (e.g. closed conformation). More specifically, because ECT is below the sixth threshold, third thermostat valve may be configured in the seventh position, without input from the vehicle controller. For example, a wax element (or other temperature sensing device) associated with the third thermostat may be substantially in a solidified form as a result of ECT being below the sixth threshold, and as such, third thermostat valve may be configured in the seventh position. With third thermostat valve configured in the seventh position, coolant may be enabled to return to the pump (e.g. 86) and to the engine (e.g. 10) from a bypass line (e.g. via coolant lines 83*b*, 24*f*, and 24*g*). Furthermore, coolant may be enabled to return to the pump and to the engine from a coolant line (e.g. 81*b*) stemming from a heater core (e.g. 90). However, because third thermostat may be configured in the seventh position as a result of ECT being below the sixth threshold, return flow from a radiator (e.g. 80), may be prevented.

Furthermore, with CRV 310 configured in a closed position (e.g. first position), coolant may be prevented from returning to the pump and engine, from vehicle cooling system components including, but not limited to, a transmission oil cooler (e.g. 125), an ATWU heat exchanger (e.g. 34), an oil cooler (e.g. 35), and a degas bottle (e.g. 37).

Thus, at 415, coolant flow throughout the vehicle cooling system may be summarized as follows. Coolant may be enabled to circulate from the engine, to one or more of at least an EGR cooler (e.g. 31), a turbo center housing (e.g. 32), and a urea injector (e.g. 33), where the vehicle system includes such components, to the heater core, and through the bypass line, prior to returning to the pump and engine. By preventing return flow from the radiator (and components such as transmission oil cooler, ATWU heat exchanger, oil cooler, and degas bottle), coolant may be rapidly warmed under conditions wherein ECT is below the sixth threshold. Furthermore, by enabling coolant to flow, rather than stagnating coolant flow at the engine, issues associated with durability resulting from uneven heating of engine (and other cooling system components), may be avoided.

In one example, the CRV may comprise a normally open solenoid valve that may be actuated closed to isolate coolant, and to improve coolant warmup. As such, at step 415, it may be understood that a vehicle controller (e.g. 12) may send a signal to the CRV, actuating the CRV to adopt a closed conformation (e.g. first position).

Proceeding to step 420, method 400 may include indicating whether ECT is above the sixth threshold. For example, ECT above the sixth threshold (but below a seventh threshold) may comprise an ECT at which return flow from one or more of the transmission oil cooler, ATWU heat exchanger, oil cooler, and degas bottle, is desired.

If, at 420, it is indicated that ECT is not greater than the sixth threshold, method 400 may proceed to step 421, and may include indicating whether a transmission oil temperature (TOT), as monitored by a transmission oil temperature sensor (e.g. 27), is above ECT by a predetermined amount. For example, a vehicle controller may receive inputs from the TOT sensor and the ECT sensor (e.g. 26), and responsive to an indication that TOT is greater than ECT by the predetermined amount, then the CRV may be commanded open (e.g. an electrical signal to the CRV may be shut off, thus resulting in the CRV opening). Accordingly, at 421, if TOT is not indicated to be greater than ECT by the predetermined amount, method 400 may return to 415, and may include maintaining the third thermostat valve in the seventh position, and maintaining the CRV in the first position. Alternatively, if TOT is indicated to be greater than ECT by the predetermined amount at 421, method 400 may proceed to 422, and may include commanding the CRV to the second position (e.g. open position). In some examples, the CRV may additionally be regulated as a function of engine speed, load, TOT, etc. For example, a data set, or map, may be stored at the controller, which may dictate when the CRV may be transitioned from the first position (closed) to the second position (open), or vice versa. Thus, control over the CRV may be referred to herein as map-controlled.

Returning to step 420, if ECT is indicated to be greater than the sixth threshold, method 400 may proceed to 425, and may include maintaining the third thermostat valve in the seventh position, and may include opening the CRV. In other words, at 425, method 400 may include configuring the CRV in a second position. As discussed above, because the CRV may comprise a normally open valve, configuring the CRV in the second position may include deactivating an electrical signal sent to the CRV via the controller. In the absence of external input from the controller, the CRV may transition from a closed position (e.g. first position) to an open position (e.g. second position), and may be maintained in an open position responsive to the absence of controller input.

Thus, at step 425, coolant may be enabled to return to the pump and engine from one or more of the transmission oil cooler (via coolant lines 87*b*, 24*d*, 24*e*, 24*f*, and 24*g*), ATWU heat exchanger (via coolant lines 88*a*, 85*b*, 24*d*, 24*e*, 24*f*, and 24*g*), oil sensor (e.g. via coolant lines 85*b*, 24*d*, 24*e*, 24*f*, and 24*g*), and degas bottle (e.g. via coolant lines 89*b*, 24*d*, 24*e*, 24*f*, and 24*g*). As such, by opening the CRV when ECT is above the sixth threshold, but below the seventh threshold, coolant may be enabled to flow from the engine, through one or more of at least an EGR cooler (e.g. 31), a turbo center housing (e.g. 32), and a urea injector (e.g. 33), to the heater core, transmission oil cooler, ATWU heat exchanger, oil cooler, degas bottle, and bypass line (e.g. 83*b*), before returning to the pump and engine. As such, coolant flow may be enabled to flow through the entirety of the vehicle cooling system, with the exception of flowing to the radiator, the result of third thermostat valve being positioned in the seventh position.

Proceeding to 430, method 400 may include determining whether ECT is greater than a seventh threshold. The seventh threshold may comprise a threshold wherein coolant flow to the radiator is desired, for additional cooling of the coolant. If, at 430, ECT is not above the seventh threshold, method 400 may return to 425, and may include maintaining the third thermostat valve in the seventh position, and may further include maintaining the CRV in the second position. However, if, at 430, ECT is indicated to be above the seventh threshold, method 400 may proceed to 435.

At 435, method 400 may include configuring the third thermostat valve in an eighth position, and maintaining the CRV in the second position. More specifically, the third thermostat temperature sensing element (e.g. 307) may be exposed to circulating engine coolant, and as a result of the ECT rising above the eighth threshold, the third thermostat valve may transition from the seventh position, to the eighth position. As an example, ECT transitioning to above the eighth threshold may include a phase change of the temperature sensing element, thus resulting in the third thermostat valve transitioning from the seventh position, to the eighth position.

With the third thermostat valve configured in the eighth position, coolant may be enabled to return to the pump, and engine, from the radiator (e.g. via coolant lines 84*d*, 24*f*, and 24*g*). As such, at step 435, it may be understood that an entire volume of coolant in the vehicle cooling system may be flowing. More specifically, by configuring the third thermostat in the eighth position, and the CRV in the second position, coolant may be enabled to flow from the engine, to one or more of at least the EGR cooler (e.g. 31), turbo center housing (e.g. 32), and urea injector (e.g. 33), through the bypass line (e.g. 83*b*), to the radiator, the heater core, the transmission oil cooler, the ATWU heat exchanger, the oil cooler, and the degas bottle. In other words, configured as described at step 435, no coolant may be prevented from flowing in any part of the vehicle cooling system.

Proceeding to step 440, method 400 may include determining whether ECT is greater than an eighth threshold. In some examples, the eighth threshold may comprise a threshold ECT, where additional cooling of the coolant may be desirable. As discussed above, the temperature sensing element of the third thermostat may sense coolant temperature, and thus, if ECT rises above the eighth threshold, the third thermostat valve may transition from the eighth position to a ninth position, as will be discussed further below. However, if at 440, ECT is indicated to be below the eighth threshold, method 400 may return to 435, and may include maintaining the third thermostat valve in the eighth position, and may further include maintaining the CRV in the second position (e.g. open configuration).

If, at 440, ECT is indicated to be above the eighth threshold, method 400 may proceed to 445. At 445, method 400 may include configuring the third thermostat in the ninth position, and may further include maintaining the CRV in the second position. As discussed above, because the third thermostat may be configured to sense ECT, the transition from the eighth position to the ninth position may occur in the absence of external input from the vehicle controller. Furthermore, maintaining the CRV in the second position may occur in the absence of external input from the vehicle controller. By transitioning the third thermostat valve from the eighth position to the ninth position, coolant may be prevented from returning from the bypass line (e.g. 83*b*), and as such, more coolant flow may be directed to the radiator. As such, the eighth threshold may comprise an ECT wherein additional cooling of the coolant may be desirable.

Thus, it may be understood that, at step 445, coolant flow may be prevented from flowing through the bypass line. However, with the exception of coolant flow being prevented from flowing through the bypass line, the rest of the volume of coolant in the vehicle cooling system may be understood to be circulating. By preventing flow of coolant through the bypass line, a volume of flow to the radiator may be increased, such that cooling of the engine coolant may be increased.

Proceeding to 450, method 400 may include continuing to control coolant flow throughout the vehicle system as a function of ECT, engine speed, engine load, TOT, etc., for the duration of the drive cycle where the engine is activated. For example, if ECT drops below the eighth threshold, but remains above the seventh threshold, the third thermostat valve may transition to the eighth position, and the CRV may be maintained in the second position. Such an example is illustrative, and is not meant to be limiting. For example, there may be condition wherein ECT drops below the seventh threshold, but remains above the sixth threshold, etc.

Turning now to FIG. 5, an example timeline 500 is shown for regulating flow of coolant in a vehicle cooling system, according to the method depicted in FIG. 2, and as applied to the system described herein and with reference to FIG. 1. Timeline 500 includes plot 505, indicating whether a vehicle engine is in operation (On), or not (off). Timeline 500 further includes plot 510, indicating engine coolant temperature (ECT), over time. Line 511 represents a first threshold (T_1), line 512 represents a second threshold (T_2), line 513 represents a third threshold (T_3), and line 514 represents a fourth threshold (T_4). It may be understood that the first through fourth thresholds may represent the first, second, third, and fourth thresholds discussed above with regard to method 200 depicted at FIG. 2. Timeline 500 further includes plot 515, indicating a position of a first thermostat valve (e.g. 42), over time. For example, the first thermostat valve (Tstat_1) may be in a first position (Post), a second position (Pos2), or a third position (Pos3). Timeline 500 further includes plot 520, indicating a position of a second thermostat valve (e.g. 63), over time. For example, the second thermostat valve (Tstat_2) may be in a fourth position (Pos4), a fifth position (Pos5), or a sixth position (Posh). Timeline 500 further includes plot 525, indicating whether flow through a bypass line (e.g. 83) is enabled (yes), or not (no), and plot 530, indicating whether flow through a heater core (e.g. 90) is enabled (yes), or not (no), over time. More specifically, flow through the bypass line, and through the heater core, being "enabled", may refer to coolant flow being enabled to return to a pump (e.g. 86) and engine (e.g. 10) after circulating through the bypass line and/or heater core, as discussed above and which will be further discussed below. Timeline 500 further includes plot 535, indicating whether coolant flow to vehicle cooling system components including a transmission oil cooler (e.g. 125), ATWU heat exchanger (e.g. 34), oil cooler (e.g. 35), and degas bottle (e.g. 37), is enabled, over time. Similar to that discussed above, coolant flow being "enabled" to flow to the transmission oil cooler, ATWU heat exchanger, oil cooler, and degas bottle, may refer to coolant being enabled to return to the pump and engine after circulating through such cooling system components. For brevity, in example timeline 500, flow through such components is referred to as Aux. Flow. Timeline 500 further includes plot 540, indicating whether flow to a radiator (e.g. 80) is enabled (e.g. enabled to return to the pump and engine), over time. Timeline 545 further includes plot 545, indicating whether a transmission oil temperature (TOT) is greater than ECT (e.g. yes, or no), by a predetermined amount, over time. Timeline 550 further includes plot 550, indicating whether a heating element (e.g. 25) associated with a second thermostat (e.g. 61), is activated (on), or not (off), over time.

At time t0, the engine is off, indicated by plot 505. ECT is indicated to be below the first threshold, indicated by plot 510. With the engine off, and with ECT below the first threshold, the first thermostat valve is in the first position, indicated by plot 515, and the second thermostat valve is in the fourth position, indicated by plot 520. When the engine is off, it may be understood that the pump (e.g. 86) is also off. Thus bypass flow, heater core flow, Aux. flow, and radiator flow, are not indicated (no), as illustrated by plots 525, 530, 535, and 540, respectively, over time. Furthermore, TOT is not indicated to be greater than ECT, illustrated by plot 545, and the second thermostat heating element is off, illustrated by plot 550.

At time t1, the engine is turned on and begins combusting fuel. With the engine activated, it may be understood that the pump may activated to circulate coolant, as the pump may be coupled to the engine via FEAD (e.g. 36), and thus may be rotated proportionally to engine speed. With the first thermostat in the first position, and the second thermostat in the fourth position, coolant may flow through the bypass line (e.g. 83), but may be prevented from flowing through the heater core, transmission oil cooler, ATWU heat exchanger, oil cooler, degas bottle, and radiator. Furthermore, while not explicitly illustrated, it may be understood that coolant may additionally flow through an exhaust gas recirculation (EGR) cooler (e.g. 31), turbo center housing (e.g. 32), and urea injector (e.g. 33). As the engine is just turned on at time t1, TOT is not indicated to be greater than ECT. Thus, second thermostat heating element is off. By isolating coolant flow to the bypass line, engine coolant may rapidly be warmed, without stagnating coolant at the engine. Accordingly, between time t1 and t2, engine coolant temperature begins rising.

At time t2, ECT is indicated to cross the first threshold, represented by line 511. As ECT crosses the first threshold, the second temperature sensing element (e.g. 62) associated with the second thermostat (e.g. 61) may undergo a phase change, for example, which may result in the second thermostat valve transitioning from the fourth position, to the fifth position. However, as ECT is below the third threshold, the first thermostat valve (e.g. 42) may remain in the first position. With the second thermostat valve in the fifth position, and the first thermostat valve in the first position, coolant flow from the engine may flow through both the bypass line and the heater core, before returning to the pump and engine.

Between time t2 and t3, engine coolant continues to warm, thus ECT is indicated to rise. At time t3, it is indicated that TOT is greater than ECT by the predetermined amount. As an example, TOT may be monitored via a TOT sensor (e.g. 27), and ECT may be monitored via an ECT sensor (e.g. 26). As TOT is indicated to be above ECT by the predetermined threshold, the second thermostat heating element (e.g. 25) is activated, indicated by plot 550. Thus, between time t3 and t4, the heating element associated with the second thermostat may result in a rise in temperature that may result in a phase transition of a second temperature sensing element. Such a phase transition may result in the second thermostat valve transitioning from the fifth position, to a sixth position. As such, with the second heating element activated at time t3, at time t4 the second thermostat valve is indicated to transition from the fifth position to the sixth position.

While in example timeline 500, the second thermostat heating element is activated responsive to an indication that TOT is greater than ECT by the predetermined amount, other possibilities may be understood to be within the scope of this disclosure. As one example, the second thermostat heating element may be activated prior to TOT being greater than ECT by the predetermined amount. In such an example, the second thermostat heating element may be activated prior to TOT being greater than ECT by the predetermined amount, such that the second thermostat valve may transition from the fifth position to the sixth position at substantially the same time as TOT rises above the ECT by the predetermined amount. For example, responsive to TOT being below ECT by a predetermined amount, the second thermostat heating element may be activated. In some examples, an amount of heat generated by the second thermostat heating element may be regulated, or controlled. For example, heat output from the second thermostat heating element may be increased, or decreased, in accordance with TOT and ECT, such that second thermostat valve opens at substantially the same time as when TOT is indicated to be above ECT by the predetermined amount. In some examples, control over the second thermostat heating element may be further regulated as a function of a data set, or map, stored at the controller (e.g. 12), such that heat may be added to the electrically-heated second thermostat to ensure optimal engine performance (e.g. such that the second thermostat valve transitions from the fifth to the sixth position at substantially the same time as when TOT is greater than ECT by the predetermined amount).

At time t4, the transition of the second thermostat valve from the fifth position to the sixth position results in coolant being enabled to flow through the aux. components, where aux. components may refer to the transmission oil cooler, ATWU heat exchanger, oil cooler, and degas bottle, before returning to the pump and engine. Furthermore, with the second thermostat valve configured in the sixth position, coolant flow through the heater cooler may be maintained. Still further, because at time t4 ECT is below the third threshold, the first thermostat valve may be maintained in the first position. As such, coolant may be enabled to flow through the bypass line prior to returning to the pump and engine, but may be prevented from flowing through the radiator. As such, at time t4, it may be understood that coolant may flow through the heater core, transmission oil cooler, ATWU heat exchanger, oil cooler, degas bottle, and bypass line, prior to returning to the pump and engine, but where coolant flow through the radiator may be prevented.

Between time t4 and t5, TOT remains above ECT, and ECT remains below the second threshold (e.g. T_2). Thus, the second thermostat heating element is maintained activated (e.g. on), such that the second thermostat valve is maintained in the sixth position. To prevent overheating of the second thermostat and second thermostat heating element, the temperature of the second thermostat heating element may be regulated, or controlled, to a temperature that maintains the second thermostat valve in the sixth position.

At time t5, ECT is indicated to cross the second threshold. Furthermore, with coolant flowing to the aux. components, including the transmission oil cooler, TOT is no longer indicated to be above ECT. As discussed above, ECT above the second threshold may comprise an ECT that may result in a phase transition of the second thermostat temperature sensing element to undergo a phase transition that may result in the second thermostat valve transitioning between the fifth position and the sixth position. However, because heat was actively added to the second thermostat as a result of the TOT being greater than ECT by the predetermined amount, the second thermostat valve is already configured in the sixth position at time t5. Thus, with ECT above the second threshold at time t5, activation of the second thermostat heating element may be discontinued. In other words, the second thermostat heating element may be turned off, as the ECT may maintain the second thermostat valve in the sixth position.

Between time t5 and t6, ECT continues to warm. At time t6, ECT crosses the third threshold. With ECT above the third threshold, the first thermostat valve may transition from the first position, to the second position. For example, a phase change of a first temperature sensing element (e.g. 41) as a result of the ECT crossing the second threshold may result in the first thermostat valve transitioning from the first position to the second position. With the first thermostat valve in the second position, coolant may be enabled to flow through the bypass line, and through the radiator, prior to returning to the pump and engine. Furthermore, with the second thermostat valve being configured in the sixth position, coolant may be enabled to flow through the heater core, the transmission oil cooler, the ATWU heat exchanger, the oil cooler, and the degas bottle, prior to returning to the pump and engine. As such, it may be understood that an entire volume of coolant may be flowing through the vehicle cooling system at time t6.

Between time t6 and t7, ECT remains above the third threshold, but below the fourth threshold. Thus, the entire volume of coolant in the vehicle system may be circulating between time t6 and t7. At time t7, ECT is indicated to cross the fourth threshold. ECT above the fourth threshold may result in a further phase change of the first temperature sensing element, such that the first thermostat valve may transition from the second position, to a third position. With the first thermostat valve configured in the third position, coolant may be enabled to flow through the radiator prior to returning to the pump and engine, but may be prevented from flowing through the bypass line. Thus, it may be understood that with ECT above the fourth threshold, additional cooling of the engine coolant may be desirable, thus a greater volume of coolant may be directed through the radiator, as a result of preventing coolant from flowing through the bypass line. As such, at time t7, coolant flow through the bypass line is indicated to be stopped, illustrated by plot 525. Subsequent to time t7, ECT remains above the fourth threshold. Thus, coolant may flow from the engine, to the heater core, the transmission oil cooler, ATWU heat exchanger, oil cooler, degas bottle, and radiator, while being prevented from flowing through the bypass line.

Timeline 500 illustrates a segment of a drive cycle, and as such, it may be understood that coolant flow may be continued to be regulated throughout the rest of the drive cycle (e.g. subsequent to time t7. For example, as discussed above with regard to FIG. 2, there may be circumstances wherein ECT drops below the fourth threshold, but remains above the third threshold, or drops below the third threshold, but remains above the second threshold, etc. Thus, coolant flow may continue to be regulated according the method depicted in FIG. 2, for the duration of a drive cycle, under conditions wherein the engine is activated.

Turning now to FIG. 6, an example timeline 600 is shown for regulating flow of coolant in a vehicle cooling system, according to the method depicted in FIG. 4, and as applied to the system described herein and with reference to FIG. 3. Timeline 600 includes plot 605 indicating whether a vehicle engine is on, or off, over time. Timeline 600 further includes plot 610, indicating engine coolant temperature (ECT), over time. Line 611 represents a sixth threshold (T_6), line 612 represents a seventh threshold (T_7), and line 613 represents an eighth threshold (T_8). It may be understood that the sixth through eighth thresholds may represent the sixth, seventh, and eighth thresholds discussed above with regard to method 400 depicted at FIG. 4. Timeline 600 further includes plot 615, indicating whether a third thermostat valve (e.g. 306) associated with a third thermostat (e.g. 305), is in a first position, a second position, or a third position, over time. Timeline 600 further includes plot 620, indicating whether a coolant return valve (CRV) (e.g. 310) is in a first position (closed), or a second position (open), over time. Timeline 600 further includes plot 625, indicating whether coolant may be enabled to flow through a bypass line (e.g. 83) prior to returning to a pump (e.g. 86) and engine (e.g. 10), over time. Timeline 600 further includes plot 630, indicating whether coolant may be enabled to flow through a heater core (e.g. 90), prior to returning to the pump and engine, over time. Timeline 600 further includes plot 635, indicating whether coolant may be enabled to flow through Aux. components, prior to returning to the pump and engine, over time. As discussed above with regard to timeline 500, Aux. components may refer to vehicle cooling system components including a transmission oil cooler (e.g. 125), an ATWU heat exchanger (e.g. 34), an oil cooler (e.g. 35), and a degas bottle (e.g. 37). Timeline 600 further includes plot 640, indicating whether coolant may flow through a radiator (e.g. 80), prior to returning to the pump and engine, over time. Timeline 600 further includes plot 645, indicating whether a transmission oil temperature (TOT) is greater than ECT by a predetermined amount, over time.

At time t0, the engine is off, indicated by plot 605. With the engine in an off state, ECT is indicated to be below the sixth threshold, indicated by plot 610. With ECT below the sixth threshold, the third thermostat valve is indicated to be configured in the first position, indicated by plot 615. Furthermore, with the engine off, the CRV may be configured in the second position. For example, the CRV may comprise a normally open solenoid valve that may be actuated closed. As such, with the engine off, the CRV may be in the second position (e.g. open), without external input from a vehicle controller (e.g. 12). Furthermore, with the engine off, coolant may not flow to any of the bypass line, indicated by plot 625, the heater core, indicated by plot 630, the radiator, indicated by plot 640, or any of the aux. components such as transmission oil cooler, ATWU heat exchanger, oil cooler, and degas bottle, indicated by plot 635. For example, because the engine is off, the pump (e.g. 86) may be off, as the pump may be driven by the engine via a belt, chain, etc. Still further, as the engine is off, TOT is not indicated to be greater than ECT, indicated by plot 645.

At time t1, the vehicle engine is turned on and begins combusting fuel. With the engine activated, it may be understood that the pump may be activated to circulate coolant. As ECT is below the sixth threshold, the third thermostat valve is configured in the first position. For example, a temperature sensing element (e.g. 307) associated with the third thermostat valve (e.g. 306) may undergo phase changes responsive to ECT. When ECT is below the sixth threshold, the third temperature sensing element may be in a state that results in the third thermostat valve being in the first position. With the third thermostat valve configured in the first position, engine coolant may be enabled to flow from the engine, to one or more of at least an exhaust gas recirculation (EGR) cooler (e.g. 31), turbo center housing (e.g. 32), urea injector (e.g. 33), bypass line (e.g. 83*b*), and heater core (e.g. 90). However, coolant may be prevented from flowing to the radiator (e.g. 80). Furthermore, at time t1, as ECT is below the sixth threshold, the CRV may be commanded, via the controller, to adopt the second position. More specifically, the controller may send a signal, actuating the CRV closed. With the CRV closed, coolant may be prevented from returning to the pump and engine from each of at least the transmission oil cooler, ATWU heat exchanger, oil cooler, and degas bottle. As such, at time t1, a volume of coolant circulating may comprise a fraction of the total volume of coolant in the vehicle cooling system. By preventing coolant from flowing through the transmission oil cooler, ATWU heat exchanger, oil cooler, and degas bottle, engine coolant may be rapidly warmed. Furthermore, by enabling the coolant to circulate in an isolated section of the vehicle cooling system, the coolant may be rapidly warmed without stagnating coolant flow at the engine.

Between time t1 and t2, ECT rises, as a result of the engine being in operation and the coolant circulating through the engine and through an isolated section of the vehicle cooling system. At time t2, ECT crosses the sixth threshold. Responsive to ECT crossing the sixth threshold, the CRV may be commanded to the second position (e.g. open position). In some examples, prior to ECT crossing the sixth threshold, the CRV may be commanded to the second position as a function of whether TOT is greater than ECT by a predetermined amount. For example, as discussed above, a TOT sensor and an ECT sensor may be utilized to determine a relationship between TOT and ECT. If ECT is below the sixth threshold, but it is indicated that TOT is greater than ECT by the predetermined amount, then the CRV may be commanded open. In still further examples the CRV may be commanded open to ensure optimal engine performance, as a function of engine speed, load, TOT, etc. However, in example timeline 600, TOT is not indicated to be above ECT by the predetermined amount, illustrated by plot 645, prior to ECT crossing the sixth threshold. As such, the CRV is commanded to the second position responsive to the indication that ECT crossed the sixth threshold at time t2.

By commanding the CRV to the second position at time t2, coolant may be enabled to flow through the transmission oil cooler, ATWU heat exchanger, oil cooler, and degas bottle, prior to returning to the pump and engine. Furthermore, with ECT above the sixth threshold, but below the seventh threshold, ECT may be enabled to circulate through the heater core and the bypass line prior to returning to the pump and engine, but may be prevented from flowing through the radiator.

Between time t2 and t3, ECT continues to rise. During the time period between time t2 and t3, coolant may be continued to circulate from the engine, through each of the heater core, transmission oil cooler, ATWU heat exchanger, oil cooler, degas bottle, and bypass line, prior to returning to the pump and engine. Furthermore, flow through the radiator may be prevented by the third thermostat valve being configured in the first position.

At time t3, ECT crosses the seventh threshold. Responsive to ECT crossing the seventh threshold, the third temperature sensing element may undergo a phase change that may result in the third thermostat valve transitioning from the first position to the second position. With the third thermostat valve configured in the second position, coolant may be enabled to additionally flow through the radiator, prior to returning to the pump and engine. As such, at time t3, it may be understood that an entire volume of coolant may be flowing throughout the vehicle cooling system, with no section of the cooling system isolated from coolant flow.

Between time t3 and t4, engine coolant temperature continues to rise, and at time t4, ECT is indicated to cross the eighth threshold. The eighth threshold may comprise a threshold ECT wherein additional cooling of the engine coolant may be desirable. As such, at time t4, with ECT crossing the eighth threshold, the temperature sensing element associated with the third thermostat may undergo a phase change, that may result in the third thermostat valve adopting the third position. When configured in the third position, the third thermostat valve may enable coolant to flow from the engine, to the radiator, and heater core but may prevent coolant from flowing through the bypass line, indicated by plot 625. As such, by preventing coolant from flowing through the bypass line, the engine coolant may be cooled more effectively than if coolant were able to circulate through the bypass line.

With the additional cooling of the coolant enabled as a result of the third thermostat adopting the third conformation, ECT rises and then begins to fall during the time period between time t4 and t5, and at time t5, ECT is indicated to fall below the eighth threshold. Responsive to ECT falling below the eighth threshold, the third thermostat may transition from the third position, back to the second position. Accordingly, with the third thermostat valve configured in the second position, bypass flow is once again enabled. As such, between time t5 and t6, it may be understood that again, the entire volume of engine coolant may be circulating throughout the vehicle cooling system.

Timeline 600 illustrates a segment of a drive cycle, and as such, it may be understood that coolant flow may be continued to be regulated throughout the rest of the drive cycle (e.g. subsequent to time t6. For example, as discussed above with regard to FIG. 4, there may be circumstances wherein ECT drops below the eighth threshold, but remains above the seventh threshold, or drops below the seventh threshold, but remains above the sixth threshold, etc. Thus, coolant flow may continue to be regulated according the method depicted in FIG. 4, for the duration of a drive cycle, under conditions wherein the engine is activated.

In this way, coolant flow may be regulated during an engine startup event, such that the coolant is rapidly warmed. Coolant may be selectively controlled to flow through various segments of the vehicle cooling system, responsive to engine coolant temperature, and may further be controlled as a function of engine speed, load, transmission oil temperature, etc. By selectively controlling where coolant may flow during an engine startup event, engine coolant may be rapidly warmed, without stagnating coolant at the engine.

The technical effect is to recognize that vehicle cooling system flow may be regulated to achieve rapid warming of the engine coolant, with minimal input from the vehicle controller, and without stagnating coolant flow at the engine, which may result in durability issues as a result of uneven heating of engine system components. In one example, two conventional thermostats with temperature sensing elements, such as wax elements, may be strategically positioned in a vehicle cooling system, to enable rapid warming of engine coolant via engine coolant flow isolation, rather than engine coolant stagnation at the engine. In such an example, one thermostat may comprise an electrically-heated thermostat, to facilitate active control over which position the thermostat valve is in. In another example, one conventional thermostat may be strategically positioned in a vehicle cooling system, and coolant flow may additionally be regulated via a solenoid actuated valve. In such an example, coolant flow may be rapidly warmed without stagnating the coolant at the engine, and wherein the only active control over the coolant flow comprises the vehicle controller commanding closed the solenoid actuated valve. Thus, the systems and methods depicted herein enable rapid warming of engine coolant during an engine startup event, without stagnating coolant at the engine, and which may be achieved without the use of complicated electric valve option.

The systems described herein, and with reference to FIG. 1 and FIG. 3, along with the methods described herein and with reference to FIG. 2 and FIG. 4, may enable one or more systems and one or more methods. In one example, a method comprises during an engine startup event, controlling a flowpath of an engine coolant in a vehicle cooling system via a passive valve and an actively regulatable valve; and responsive to an engine coolant temperature below a threshold at the engine startup event, isolating the flowpath of engine coolant to a subsection of the cooling system to enable rapid warming of the engine coolant without stagnating the engine coolant at an engine. In a first example of the method the method further includes wherein controlling the flowpath of the engine coolant in the vehicle cooling system via the passive valve comprises controlling the flowpath of the engine coolant in the vehicle cooling system via a first thermostat valve of a first thermostat positioned on a hot-side of the engine, including controlling the first thermostat valve to a first, a second, or a third position based on engine coolant temperature as sensed by a first temperature sensing element of the first thermostat, without input from a vehicle controller. A second example of the method optionally includes the first example, and further includes wherein controlling the flowpath of the engine coolant in the vehicle cooling system via the actively regulatable valve comprises controlling the flowpath of the engine coolant in the vehicle cooling system via a second thermostat valve of a second thermostat positioned on a cold-side of the engine, including one or more of: controlling the second thermostat valve to a fourth, a fifth, or a sixth position based on engine coolant temperature as sensed by a second temperature sensing element of the second thermostat without input from the vehicle controller; and controlling the second thermostat valve to the fifth or sixth position actively by activating an electric heater associated with the second thermostat thereby raising a temperature of the second thermostat. A third example of the method optionally includes any one or more or each of the first and second examples, and further includes wherein isolating coolant flow to the subsection of the cooling system comprises isolating the coolant flow to a subsection of the cooling system including a bypass line in a first condition, prior to returning to the engine, via the first thermostat valve in the first position and the second thermostat valve in the fourth position; wherein the threshold is a first threshold, and further comprising responsive to a second condition including engine coolant temperature above the first threshold but below a second threshold, flowing coolant from the engine through both the bypass line and a heater core, prior to returning to the engine, via the first thermostat valve in the first position and the second thermostat valve in the fifth position. A fourth example of the method optionally includes any one or more or each of the first through third examples, and further comprises routing coolant flow from the engine through each of the bypass line, the heater core, a transmission oil cooler, an automatic transmission warmup heat exchanger, and a degas bottle, prior to returning to the engine in a third condition, wherein the third condition includes either engine coolant temperature above the second threshold, but below a third threshold, or responsive to a transmission oil temperature above engine coolant temperature by a predetermined amount and engine coolant temperature below the second threshold; wherein routing coolant flow through each of the bypass line, the heater core, the transmission oil cooler, the automatic transmission warmup heat exchanger, and the degas bottle includes the first thermostat valve in the first position and the second thermostat valve in the sixth position; and wherein responsive to the transmission oil temperature above engine coolant temperature by the predetermined amount and engine coolant temperature below the second threshold, activating the electric heater associated with the second thermostat to configure the second thermostat valve in the sixth position. A fifth example of the method optionally includes any one or more or each of the first through fourth examples, and further comprises routing coolant flow from the engine, through each of the bypass line, the heater core, the transmission oil cooler, the automatic transmission warmup heat exchanger, the degas bottle, and a radiator, prior to returning to the engine in a fourth condition, responsive to engine coolant temperature above the third threshold, but below a fourth threshold; wherein routing coolant flow from the engine, through each of the bypass line, the heater core, the transmission oil cooler, the automatic transmission warmup heat exchanger, the degas bottle, and the radiator includes the first thermostat valve in the second position and the second thermostat valve in the sixth position; and routing coolant flow from the engine, through each of the heater core, the transmission oil cooler, the automatic transmission warmup heat exchanger, the degas bottle, and the radiator, prior to returning to the engine in a fifth condition, responsive to engine coolant temperature above the fourth threshold; wherein routing coolant flow from the engine, through each of the heater core, the transmission oil cooler, the automatic transmission warmup heat exchanger, the degas bottle, and the radiator includes the first thermostat valve in the third position and the second thermostat valve in the sixth position, and wherein coolant is prevented from flowing through the bypass line in the fifth condition. A sixth example of the method optionally includes any one or more or each of the first through fifth examples and further includes wherein controlling the flowpath of the engine coolant in the vehicle cooling system via the passive valve comprises controlling the flowpath of the engine coolant in the vehicle cooling system via a third thermostat valve of a third thermostat positioned on a cold-side of the engine, including controlling the third thermostat valve to a seventh, an eighth, or a ninth position based on engine coolant temperature as sensed by a third temperature sensing element of the third thermostat, without input from a vehicle controller. A seventh example of the method optionally includes any one or more or each of the first through sixth examples and further includes wherein controlling the flowpath of the engine coolant in the vehicle cooling system via the actively regulatable valve comprises controlling the flowpath of the engine coolant in the vehicle cooling system via an actuatable solenoid valve positioned on the cold-side of the engine, and where the actuatable solenoid valve is configurable in an open position, or a closed position. An eighth example of the method optionally includes any one or more or each of the first through seventh examples, and further includes wherein isolating coolant flow to the subsection of the cooling system comprises isolating the coolant flow to a subsection of the cooling system including a bypass line and a heater core in a sixth condition, prior to returning to the engine, via the third thermostat valve in the seventh position, and the actuatable solenoid valve in the closed position. A ninth example of the method optionally includes any one or more or each of the first through eighth examples and further comprises routing coolant flow from the engine, through each of the bypass line, the heater core, a transmission oil cooler, an automatic transmission warmup heat exchanger, an oil cooler, and a degas bottle in a seventh condition, prior to returning to the engine, responsive to either engine coolant temperature above the sixth threshold, but below a seventh threshold, or a transmission oil temperature above engine coolant temperature by a predetermined amount and engine coolant temperature below the sixth threshold; wherein routing coolant flow from the engine, through each of the bypass line, the heater core, the transmission oil cooler, the automatic transmission warmup heat exchanger, the oil cooler, and the degas bottle includes the third thermostat valve in the seventh position and the actuatable solenoid valve in the open position. A tenth example of the method optionally includes any one or more or each of the first through ninth examples and further comprises routing coolant flow from the engine, through each of the bypass line, the heater core, the transmission oil cooler, the automatic transmission warmup heat exchanger, the oil cooler, the degas bottle, and a radiator, in an eighth condition, prior to returning to the engine, responsive to engine coolant temperature above the seventh threshold but below an eighth threshold; wherein routing coolant flow from the engine, through each of the bypass line, the heater core, the transmission oil cooler, the automatic transmission warmup heat exchanger, the oil cooler, the degas bottle, and the radiator includes the third thermostat valve in the eighth position and the actuatable solenoid valve in the open position; and routing coolant flow from the engine, through each of the heater core, the transmission oil cooler, the automatic transmission warmup heat exchanger, the oil cooler, the degas bottle, and the radiator, but where coolant flow through the bypass line is prevented, in a ninth condition, prior to returning to the engine, responsive to engine coolant temperature above the eighth threshold; wherein routing coolant flow from the engine, through each of the heater core, the transmission oil cooler, the automatic transmission warmup heat exchanger, the oil cooler, the degas bottle, and the radiator includes the third thermostat valve in the ninth position and the actuatable solenoid valve in the open position.

Another example of a method comprises during a first condition, flowing a first, smaller volume of coolant through a vehicle coolant system, the first volume of coolant routed through an engine and a bypass line via a first thermostat valve of a first thermostat positioned on a hot side of the engine being in a first position and a second thermostat valve of a second thermostat positioned on a cold side of the engine being in a fourth position; during a second condition, flowing a second, larger volume of coolant through the vehicle coolant system, the second volume of coolant routed through the engine, the bypass line, and through a heater core via the first thermostat valve in the first position and the second thermostat valve in a fifth position; and wherein the first condition includes an engine coolant temperature below a first threshold, and wherein the second condition includes engine coolant temperature above the first threshold, but below a second threshold. In a first example of the method, the method further comprises wherein the first thermostat comprises a wax element thermostat, and wherein the second thermostat comprises an electrically-heated thermostat. A second example of the method optionally includes the first example and further comprises during a third condition, flowing a third volume of coolant, larger than the second volume, through the vehicle coolant system, the third volume of coolant routed through the engine, the bypass line, the heater core, and an auxiliary loop, via the first thermostat valve in the first position and the second thermostat valve in a sixth position. A third example of the method optionally includes any one or more or each of the first and second examples, and further includes wherein routing coolant through the auxiliary loop includes flowing coolant through one or more of a transmission oil cooler, an automatic transmission warm-up heat exchanger, an oil cooler, and a degas bottle. A fourth example of the method optionally includes any one or more or each of the first through third examples and further includes wherein the third condition includes engine coolant temperature above the second threshold, but below a third threshold. A fifth example of the method optionally includes any one or more or each of the first through fourth examples and further comprises monitoring a transmission oil temperature via a transmission oil temperature sensor; and wherein the third condition includes a transmission oil temperature greater than engine coolant temperature by a predetermined amount, and engine coolant temperature below the second threshold. A sixth example of the method optionally includes any one or more or each of the first through fifth examples and further comprises actively raising a temperature of the second thermostat via an electric heater coupled to the second thermostat; and wherein actively raising the temperature of the second thermostat includes actively raising the temperature to configure the second thermostat valve in the sixth position. A seventh example of the method optionally includes any one or more or each of the first through sixth examples and further comprises during a fourth condition, flowing a fourth volume of coolant, larger than the third volume, through the vehicle coolant system, the fourth volume of coolant routed through the engine, the bypass line, the heater core, the auxiliary loop, and the radiator, via the first thermostat valve in a second position, and the second thermostat valve in the sixth position; wherein the fourth condition includes engine coolant temperature above the third threshold, but below a fourth threshold; and wherein the fourth volume of coolant comprises an entire volume of coolant in the vehicle cooling system. An eighth example of the method optionally includes any one or more or each of the first through seventh examples and further comprises during a fifth condition, flowing a fifth volume of coolant, smaller than the fourth volume, through the vehicle coolant system, the fifth volume of coolant routed through the engine, the heater core, the auxiliary loop, and the radiator, but wherein coolant flow is prevented from flowing through the bypass line, via the first thermostat in a third position, and the second thermostat valve in the sixth position; and wherein the fifth condition includes engine coolant temperature above the fourth threshold.

An example of a system for a vehicle comprises a coolant system configured to circulate coolant through an engine, an EGR cooler, a turbo center housing, a urea injector, a bypass line, a radiator, a heater core, and an auxiliary loop; a first thermostat with a first thermostat valve and a first temperature sensing element, positioned on a hot-side of the engine, and configured to receive coolant from the engine and to direct coolant through the bypass line in a first position, through the bypass line and the radiator in a second position, and through the radiator but not the bypass line in a third position; a second thermostat with a second thermostat valve and a second temperature sensing element positioned on a cold-side of the engine, and configured to receive coolant from the bypass line in a fourth position, from the bypass line and the heater core in a fifth position, and from the bypass line, heater core, radiator, and auxiliary loop in a sixth position; a pump configured to circulate the coolant, the pump positioned in a coolant line between the engine and the second thermostat; and wherein the coolant system is configured such that the EGR cooler, the turbo center housing, and the urea injector receive coolant flow when the engine is operating and when the first thermostat is in any of the first through third positions, and when the second thermostat is in any of the fourth through sixth positions. In a first example, the system further includes wherein the first thermostat valve is configured in the first position and the second thermostat valve is configured in the fourth position responsive to engine coolant temperature below a first threshold; wherein the first thermostat valve is configured in the first position and the second thermostat valve is configured in the fifth position responsive to engine coolant temperature above the first threshold, but below a second threshold; wherein the first thermostat valve is configured in the first position and the second thermostat valve is configured in a sixth position responsive to engine coolant temperature above the second threshold, but below a third threshold; wherein the first thermostat valve is configured in the second position and the second thermostat valve is configured in the sixth position responsive to engine coolant temperature above the third threshold, but below a fourth threshold; and wherein the first thermostat valve is configured in a third position and the second thermostat valve is configured in the sixth position responsive to engine coolant temperature above the fourth threshold. A second example of the system optionally includes the first example, and further comprises an electric heater configured to raise a temperature of the second thermostat; a transmission oil temperature sensor; an engine coolant temperature sensor; and a controller, storing instructions in non-transitory memory, that when executed, cause the controller to: monitor transmission oil temperature and engine coolant temperature; and responsive to transmission oil temperature above engine coolant temperature by a predetermined amount, and further responsive to engine coolant temperature below the second threshold: activate the electric heater to raise the temperature of the second thermostat to a temperature above the second threshold, to configure the second thermostat in the sixth position. A third example of the system optionally includes any one or more or each of the first and second examples, and further includes wherein the auxiliary loop includes at least a transmission oil cooler, an automatic transmission warmup heat exchanger, an oil cooler, and a degas bottle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

during an engine startup event, controlling a flowpath of an engine coolant in a vehicle cooling system via a passive valve and an actively regulatable valve; and responsive to an engine coolant temperature below a threshold at the engine startup event, isolating the flowpath of engine coolant to a subsection of the cooling system to enable rapid warming of the engine coolant without stagnating the engine coolant at the engine;

wherein controlling the flowpath of the engine coolant in the vehicle cooling system via the passive valve comprises controlling the flowpath of the engine coolant in the vehicle cooling system via a first thermostat valve of a first thermostat positioned on a hot-side of the engine, including controlling the first thermostat valve to a first, a second, or a third position based on engine coolant temperature as sensed by a first temperature sensing element of the first thermostat, without input from a vehicle controller.

2. The method of claim 1, wherein controlling the flowpath of the engine coolant in the vehicle cooling system via the actively regulatable valve comprises controlling the flowpath of the engine coolant in the vehicle cooling system via a second thermostat valve of a second thermostat positioned on a cold-side of the engine, including one or more of:

controlling the second thermostat valve to a fourth, a fifth, or a sixth position based on engine coolant temperature as sensed by a second temperature sensing element of the second thermostat without input from the vehicle controller; and controlling the second thermostat valve to the fifth or sixth position actively by activating an electric heater associated with the second thermostat thereby raising a temperature of the second thermostat.

3. The method of claim 2, wherein isolating coolant flow to the subsection of the cooling system comprises isolating the coolant flow to the subsection of the cooling system including a bypass line in a first condition, prior to returning to the engine, via the first thermostat valve in the first position and the second thermostat valve in the fourth position;

wherein the threshold is a first threshold, and further comprising responsive to a second condition including engine coolant temperature above the first threshold but below a second threshold, flowing coolant from the engine through both the bypass line and a heater core, prior to returning to the engine, via the first thermostat valve in the first position and the second thermostat valve in the fifth position.

4. The method of claim 3, further comprising:

routing coolant flow from the engine through each of the bypass line, the heater core, a transmission oil cooler, an automatic transmission warmup heat exchanger, and a degas bottle, prior to returning to the engine in a third condition, wherein the third condition includes either engine coolant temperature above the second threshold, but below a third threshold, or responsive to a transmission oil temperature above engine coolant temperature by a predetermined amount and engine coolant temperature below the second threshold;

wherein routing coolant flow through each of the bypass line, the heater core, the transmission oil cooler, the automatic transmission warmup heat exchanger, and the degas bottle includes the first thermostat valve in the first position and the second thermostat valve in the sixth position; and wherein responsive to the transmission oil temperature above engine coolant temperature by the predetermined amount and engine coolant temperature below the second threshold, activating the electric heater associated with the second thermostat to configure the second thermostat valve in the sixth position.

5. The method of claim 4, further comprising:

routing coolant flow from the engine, through each of the bypass line, the heater core, the transmission oil cooler, the automatic transmission warmup heat exchanger, the degas bottle, and a radiator, prior to returning to the engine in a fourth condition, responsive to engine coolant temperature above the third threshold, but below a fourth threshold;

wherein routing coolant flow from the engine, through each of the bypass line, the heater core, the transmission oil cooler, the automatic transmission warmup heat exchanger, the degas bottle, and the radiator includes the first thermostat valve in the second position and the second thermostat valve in the sixth position; and routing coolant flow from the engine, through each of the heater core, the transmission oil cooler, the automatic transmission warmup heat exchanger, the degas bottle, and the radiator, prior to returning to the engine in a fifth condition, responsive to engine coolant temperature above the fourth threshold;

wherein routing coolant flow from the engine, through each of the heater core, the transmission oil cooler, the automatic transmission warmup heat exchanger, the degas bottle, and the radiator includes the first thermostat valve in the third position and the second thermostat valve in the sixth position, and wherein coolant is prevented from flowing through the bypass line in the fifth condition.

6. A method comprising:

during a first condition, flowing a first, smaller volume of coolant through a vehicle coolant system, the first volume of coolant routed through an engine and a bypass line via a first thermostat valve of a first thermostat positioned on a hot-side of the engine being in a first position and a second thermostat valve of a second thermostat positioned on a cold-side of the engine being in a fourth position;

during a second condition, flowing a second, larger volume of coolant through the vehicle coolant system, the second volume of coolant routed through the engine, the bypass line, and through a heater core via the first thermostat valve in the first position and the second thermostat valve in a fifth position; and wherein the first condition includes an engine coolant temperature below a first threshold, and wherein the second condition includes engine coolant temperature above the first threshold, but below a second threshold.

7. The method of claim 6, wherein the first thermostat comprises a wax element thermostat, and wherein the second thermostat comprises an electrically-heated thermostat.

8. The method of claim 6, further comprising:

during a third condition, flowing a third volume of coolant, larger than the second volume, through the vehicle coolant system, the third volume of coolant routed through the engine, the bypass line, the heater core, and an auxiliary loop, via the first thermostat valve in the first position and the second thermostat valve in a sixth position.

9. The method of claim 8, wherein routing coolant through the auxiliary loop includes flowing coolant through one or more of a transmission oil cooler, an automatic transmission warm-up heat exchanger, an oil cooler, and a degas bottle.

10. The method of claim 8, wherein the third condition includes engine coolant temperature above the second threshold, but below a third threshold.

11. The method of claim 8, further comprising:

monitoring a transmission oil temperature via a transmission oil temperature sensor; and wherein the third condition includes a transmission oil temperature greater than engine coolant temperature by a predetermined amount, and engine coolant temperature below the second threshold.

12. The method of claim 11, further comprising:

actively raising a temperature of the second thermostat via an electric heater coupled to the second thermostat; and wherein actively raising the temperature of the second thermostat includes actively raising the temperature to configure the second thermostat valve in the sixth position.

13. The method of claim 8, further comprising:

during a fourth condition, flowing a fourth volume of coolant, larger than the third volume, through the vehicle coolant system, the fourth volume of coolant routed through the engine, the bypass line, the heater core, the auxiliary loop, and the radiator, via the first thermostat valve in a second position, and the second thermostat valve in the sixth position;

wherein the fourth condition includes engine coolant temperature above the third threshold, but below a fourth threshold; and wherein the fourth volume of coolant comprises an entire volume of coolant in the vehicle cooling system.

14. The method of claim 13, further comprising:

during a fifth condition, flowing a fifth volume of coolant, smaller than the fourth volume, through the vehicle coolant system, the fifth volume of coolant routed through the engine, the heater core, the auxiliary loop, and the radiator, but wherein coolant flow is prevented from flowing through the bypass line, via the first thermostat in a third position, and the second thermostat valve in the sixth position; and wherein the fifth condition includes engine coolant temperature above the fourth threshold.

15. A system for a vehicle, comprising:

a coolant system configured to circulate coolant through an engine, an EGR cooler, a turbo center housing, a urea injector, a bypass line, a radiator, a heater core, and an auxiliary loop;

a first thermostat with a first thermostat valve and a first temperature sensing element, positioned on a hot-side of the engine, and configured to receive coolant from the engine and to direct coolant through the bypass line in a first position, through the bypass line and the radiator in a second position, and through the radiator but not the bypass line in a third position;

a second thermostat with a second thermostat valve and a second temperature sensing element positioned on a cold-side of the engine, and configured to receive coolant from the bypass line in a fourth position, from the bypass line and the heater core in a fifth position, and from the bypass line, heater core, radiator, and auxiliary loop in a sixth position;

a pump configured to circulate the coolant, the pump positioned in a coolant line between the engine and the second thermostat; and wherein the coolant system is configured such that the EGR cooler, the turbo center housing, and the urea injector receive coolant flow when the engine is operating and when the first thermostat is in any of the first through third positions, and when the second thermostat is in any of the fourth through sixth positions.

16. The system of claim 15, wherein the first thermostat valve is configured in the first position and the second thermostat valve is configured in the fourth position responsive to engine coolant temperature below a first threshold;

wherein the first thermostat valve is configured in the first position and the second thermostat valve is configured in the fifth position responsive to engine coolant temperature above the first threshold, but below a second threshold;

wherein the first thermostat valve is configured in the first position and the second thermostat valve is configured in the sixth position responsive to engine coolant temperature above the second threshold, but below a third threshold;

wherein the first thermostat valve is configured in the second position and the second thermostat valve is configured in the sixth position responsive to engine coolant temperature above the third threshold, but below a fourth threshold; and wherein the first thermostat valve is configured in the third position and the second thermostat valve is configured in the sixth position responsive to engine coolant temperature above the fourth threshold.

17. The system of claim 16, further comprising:

an electric heater configured to raise a temperature of the second thermostat;

a transmission oil temperature sensor;

an engine coolant temperature sensor; and a controller, storing instructions in non-transitory memory, that when executed, cause the controller to:

monitor transmission oil temperature and engine coolant temperature; and responsive to transmission oil temperature above engine coolant temperature by a predetermined amount, and further responsive to engine coolant temperature below the second threshold:

activate the electric heater to raise the temperature of the second thermostat to a temperature above the second threshold, to configure the second thermostat in the sixth position.

18. The system of claim 15, wherein the auxiliary loop includes at least a transmission oil cooler, an automatic transmission warmup heat exchanger, an oil cooler, and a degas bottle.

* * * * *